US006457818B1

(12) United States Patent
Kurashima et al.

(10) Patent No.: US 6,457,818 B1
(45) Date of Patent: Oct. 1, 2002

(54) INK JET TYPE RECORDING HEAD

(75) Inventors: Norihiko Kurashima; Yoshihiro Koizumi, both of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/622,840

(22) PCT Filed: Dec. 22, 1999

(86) PCT No.: PCT/JP99/07231

§ 371 (c)(1),
(2), (4) Date: Aug. 24, 2000

(87) PCT Pub. No.: WO00/38929

PCT Pub. Date: Jul. 6, 2000

(30) Foreign Application Priority Data

Dec. 24, 1998 (JP) ..... 10-367493
Apr. 1, 1999 (JP) ..... 11-095081

(51) Int. Cl.[7] ..... B41J 2/045
(52) U.S. Cl. ..... 347/71
(58) Field of Search ..... 347/71, 68, 65, 347/72

(56) References Cited

U.S. PATENT DOCUMENTS

| | | | | |
|---|---|---|---|---|
| 4,320,406 A | | 3/1982 | Heinzl | |
| 4,528,575 A | * | 7/1985 | Matsuda et al. | 347/71 |
| 4,769,654 A | | 9/1988 | Tanaka | |
| 6,042,223 A | | 3/2000 | Katakura | |

FOREIGN PATENT DOCUMENTS

| | | | |
|---|---|---|---|
| EP | 820 871 | 1/1998 | |
| EP | 0 820 871 | 5/1998 | B41J/2/14 |
| JP | 5-57887 | 3/1993 | |
| JP | 8-224875 | 9/1996 | |
| JP | 0 915 0 511 | 6/1997 | B41J/2/045 |
| JP | 0 915 0 512 | 6/1997 | B41J/2/045 |
| JP | 0 915 6 096 | 6/1997 | B41J/2/045 |
| JP | 0 928 6 100 | 11/1997 | B41J/2/045 |
| JP | 10-119270 | 5/1998 | |
| JP | 10-217452 | 8/1998 | |
| JP | WO00 38929 | 7/2000 | B41J/2/045 |

* cited by examiner

*Primary Examiner*—Thinh Nguyen
(74) *Attorney, Agent, or Firm*—Sughrue Mion, PLLC

(57) ABSTRACT

An actuator unit (501) is provided with a plurality of pressure chambers (310) arranged in a row, and a plurality of pressure generators (17) for applying pressure to inks contained in the pressure chambers(310). A passage unit (502) is provided with a plurality of nozzle openings (23) communicating with the pressure chambers (310) to jet ink drops when pressure is applied to the inks contained in the pressure chambers (310) by the pressure generators (17), and two or more common ink chambers (330) containing inks to be supplied to the pressure chambers (310). The pressure chambers (310) arranged in a row are divided into a plurality of groups, and the common ink chambers (330(C), 330(M), 330(Y)) are assigned to the groups of the pressure chambers 310), respectively. The ink-jet recording head is capable of jetting ink drops of a plurality of kinds of inks and of forming pictures and characters in high print quality, and can be formed in a small size.

21 Claims, 18 Drawing Sheets

INK JET TYPE RECORDING HEAD

TECHNICAL FIELD

The present invention relates to a recording head for an ink-jet recording apparatus to be used as an ink-jet printer or an ink-jet plotter. More specifically, the present invention relates to the arrangement of nozzle openings and the arrangement of common ink chambers (reservoirs) in an ink-jet recording head.

BACKGROUND ART

A recording head employed in an ink-jet recording apparatus to be used as an ink-jet printer or an ink-jet plotter pressurizes ink contained in a pressure chamber communicating with a nozzle opening to jet an ink drop through the nozzle opening. Ink drops are jetted at times specified by a dot pattern while the recording head is moving in a scanning direction (a direction of the width of a recording medium). Upon the arrival of the recording head at a terminal position with respect to a widthwise direction, a recording medium, such as a paper sheet, is moved in a feed direction (sheet feed direction), and then ink drops are jetted as the recording head is moved again in the scanning direction.

A conventional ink-jet recording head, for example, is constructed by stacking an actuator unit and a passage unit. The actuator unit has a plurality of pressure chambers arranged in a row and a plurality of pressure generators for applying pressure to inks contained in the pressure chambers. The passage unit has a plurality of nozzle openings communicating with the pressure chambers to jet ink drops when the inks contained in the pressure chambers are pressurized by the pressure generators, and common ink chambers communicating with the pressure chambers and containing the ink to be supplied into the pressure chambers.

This conventional ink-jet recording head, however, has some problems.

First, if only one kind of ink can be jetted from a plurality of pressure chambers arranged in a row, a recording head intended to jet a plurality of color inks of different colors must be provided with a plurality of pressure chambers arranged in a plurality of rows and hence the recording head inevitably has a large size.

Secondly, if a plurality of pressure chambers arranged in a row are divided in a plurality of groups of pressure chambers and the groups of pressure chambers are connected to different common ink chambers, respectively, to solve the foregoing problem, the adjacent common ink chambers must be separated from each other by relatively thick partition walls to jet the inks stably. As a result, some of the pressure chambers and some of the nozzle openings, for example, four pressure chambers and four nozzle openings, must be omitted to form the partition walls. Consequently, the number of the nozzle openings for each color group must be reduced accordingly, which makes the improvement of color print quality difficult.

Thirdly, since ink supply passages for supplying the inks from external ink sources to the common ink chambers are formed in a plane including the common ink chambers and the ink supply passages are arranged side by side, a plate provided with the common ink chambers must have a large area, which increases the width of the recording head.

The present invention has been made in view of the foregoing circumstances and it is therefore an object of the present invention to provide an ink-jet recording head capable of jetting a plurality of kinds of inks, of being formed in a small size and of attaining a high print quality.

DISCLOSURE OF THE INVENTION

According to the present invention, an ink-jet recording head includes an actuator unit provided with a plurality of pressure chambers arranged in a row, and a plurality of pressure generators for applying pressure to inks contained in the pressure chambers; and a passage unit provided with a plurality of nozzle openings communicating with the pressure chambers to jet ink drops when pressures are applied to the inks contained in the pressure chambers by the pressure generators, and two or more common ink chambers containing inks to be supplied to the pressure chambers. The pressure chambers arranged in a row are divided into a plurality of groups along the row, and the common ink chambers are assigned to the groups of the pressure chambers, respectively.

Preferably, the pressure chambers are formed in a single plate, the two or more common ink chambers are formed in another single plate, and the actuator unit and the passage unit are stacked together.

Preferably, each of the pressure chambers has a first end part and a second end part, the nozzle openings are connected to the first or the second end parts, the common ink chambers are connected to the second or the first end parts, the same end parts of the pressure chambers included in the same group are connected to the nozzle openings, and the end parts connected to the nozzle openings are different between one of the groups and the other group adjacent to the one of the groups.

Preferably, a first plate, a second plate, a third plate and a fourth plate are stacked successively, the first plate is provided with a plurality of pressure chamber forming holes forming the pressure chambers, respectively, the second plate is provided with a plurality of pairs of connecting holes connected to the first and the second end parts of the pressure chambers, respectively, the third plate is provided with a plurality of ink supply ports each connected to one of the connecting holes of each pair and two or more common ink chamber forming holes connected to the other one of the connecting holes of each pair and forming the two or more common ink chambers, and the fourth plate is provided with the nozzle openings.

Preferably, a fifth plate is sandwiched between the second and the third plate. The fifth plate has a thin-wall part serving as a compliance part formed in a region overlapping the common ink chamber forming hole formed in the third plate to absorb a variation of a pressure applied to the ink contained in the common ink chamber.

Preferably, at least one of the two or more common ink chambers is formed in a region overlapping a region in which the pressure chambers are formed and the other common ink chamber is formed in a region outside the region in which the pressure chambers are formed.

Preferably, the pressure generators include a plurality of piezoelectric vibrators and a plurality of terminals connected to the piezoelectric vibrators to apply voltages to the piezoelectric vibrators, and the two or more common ink chambers are formed in a region outside a region in which the terminals are formed.

Preferably, in addition to the pressure chambers arranged in a row, a plurality of pressure chambers are formed in another row parallel to the row of the pressure chambers, and a common ink chamber containing an ink to be supplied to all the pressure chambers is arranged in the another row.

Preferably, the adjacent groups of the pressure chambers are separated from each other by a partition wall of a width substantially corresponding to a width of the pressure chamber.

Preferably, the passage unit is provided further with two or more ink passages for supplying inks to the two or more common ink chambers, each of the pressure chambers has a first end part and a second end part, the nozzle openings are connected to the first end parts, the common ink chambers are connected to the second end parts, and at least one of the two or more common ink chambers is formed on a side opposite to a side on which the other common ink chamber is formed with respect to a line along which the second end parts of the pressure chambers are arranged.

Preferably, the common ink chamber formed in a region outside a region in which the pressure chambers are formed has a width decreasing in a direction away from the second end parts of the pressure chambers.

Preferably, the common ink chamber formed in the region outside the region in which the pressure chambers are formed has a downstream wall forming the common ink chamber at a position remote from an upstream end of the ink passage, the downstream wall is inclined at an angle in a range of 30° to 45° to the line along which the second end parts of the pressure chambers are arranged.

Preferably, the common ink chamber formed in the region outside the region in which the pressure chambers are formed has an upstream wall forming the common ink chamber at a position near an upstream end of the ink passage, the upstream wall extends substantially perpendicularly to the line along which the second end parts of the pressure chambers are arranged.

Preferably, the ink passages are formed in a plane including the common ink chambers.

Preferably, a number of the common ink chambers is at least three, at least two of the common ink chambers are formed in the region outside the region in which the pressure chambers are formed, and at least two of the ink passages connected to the at least two of the common ink chambers are formed in arcs of substantially concentric circles, respectively.

Preferably, a distance between the at least two of the ink passages connected to the at least two of the common ink chambers formed in the region outside the region in which the pressure chambers are formed is substantially constant over substantially entire lengths of the at least two of the ink passages.

Preferably, a part of the common ink chamber is formed by a thin-wall portion and a part of the ink passage is formed by a thin-wall portion near the common ink chamber.

Preferably, each of the at least two of the ink passages has a substantially uniform width over a substantially entire length thereof.

Preferably, the groups of the pressure chambers correspond to colors of the inks to be jetted through the nozzle openings, respectively.

Preferably, the pressure chambers are arranged in a plurality of rows.

In the ink-jet recording head of the foregoing construction in accordance with the present invention, the pressure chambers arranged in a row are divided into a plurality of groups, and the common ink chambers are formed respectively for the groups of pressure chambers. Therefore, a plurality of kinds of inks can be jetted and a high print quality can be attained. The ink-jet print head can be formed in a small size. Since the actuator unit provided with the pressure chambers and the passage unit provided with the common ink chambers are stacked, the design of the recording head can be easily changed.

According to the present invention, the first or the second end parts of all the pressure chambers belonging to each group are connected to the nozzles openings The first end parts of the pressure chambers belonging to the group are connected to the nozzle openings if the second end parts of the pressure chambers belonging the group adjacent to the former group are connected to the nozzle holes. Therefore, the common ink chambers do not need to be separated from each other by thick partition walls and hence only a small number of pressure chambers need to be sacrificed for the partition walls. Consequently, the number of nozzle openings for each group of pressure chambers can be increased and hence print quality can be improved.

When the groups are assigned to colors of inks, the groups of nozzles for different colors are spaced apart, the mixing of different colors that occurs during cleaning can be limited to the least extent.

According to the present invention, at least one of the two or more common ink chambers is disposed opposite to the other common ink chambers with respect to the row of the ink supply ports, the outward expansion of the common chambers is suppressed, the common chambers can be disposed in the smallest possible dead space on the plate and hence the recording head can be formed in a small width.

BEST MODE FOR CARRYING OUT THE INVENTION

First Embodiment

An ink-jet recording head in a first embodiment according to the present invention will be described with reference to the accompanying drawings.

Figure 1:
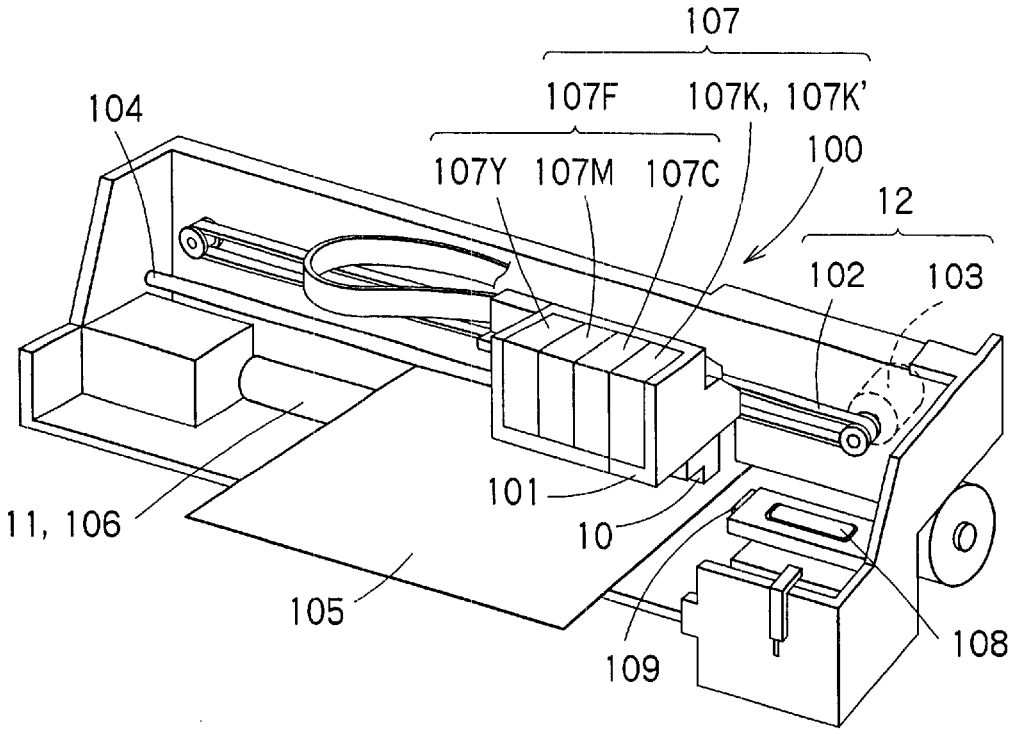
FIG. 1 is a perspective view of an essential portion of an ink-jet recording apparatus provided with an ink-jet recording head in a first embodiment according to the present invention.

FIG. 1 is a perspective view of an essential portion of an ink-jet recording apparatus (ink-jet printer) provided with the ink-jet recording head in the first embodiment. As shown in FIG. 1, the ink-jet recording apparatus 1 has a color ink-jet printing unit 100 connected to a computer, not shown. The computer loaded with predetermined programs executes the programs to control the printing unit 100 for color printing.

In the printing unit 100, a carriage 101 is connected to a timing belt 102. The carriage 101 is driven for reciprocation along the width of a recording sheet 105 along a guide member 104 through the timing belt 102 by a carriage driving motor 103 included in a carriage driving mechanism 12. The printing unit 100 is provided with a sheet feed mechanism 11 including a sheet feed roller 106. An ink-jet recording head 10 is attached to a surface facing the recording sheet 105, i.e., the lower surface of the carriage 101 shown in the figure. The recording head 10 is replenished with inks from two ink cartridges 107K and 107F mounted on the carriage 101. The recording head 10 jets ink drops in dots on the recording sheet 105 as the carriage 101 is moved to print images and characters on the recording sheet 105. The ink cartridge 107K has a black ink tank 107K' containing black (B) ink to supply the black ink to the recording head 10.

The ink cartridge 107F is used for color printing. The ink cartridge 107F has a plurality of ink tanks 107C, 107M and 107Y containing different color inks. The ink tanks 107C, 107M and 107Y contain a cyan (C) ink, a magenta (M) ink and an yellow (Y) ink, respectively. Those color inks are supplied individually to the recording head 10.

A capping device 108 is disposed in a nonprinting region (nonrecording region) in the printing unit 100 to cover nozzle openings of the recording head 10 while the printing operation of the printing unit 10 is suspended. Thus, it is possible to suppress increase in the viscosity of the inks or formation of ink films due to the evaporation of the solvent of the inks during the suspension of the printing operation. Consequently, the clogging of nozzles during the suspension of the printing operation can be prevented. The capping device 108 receives ink drops made to drip from the recording head 10 by a flashing operation performed during the printing operation. A wiping device 109 is disposed near the capping device 108. The wiping device 109 wipes the surface of the recording head 10 with a blade or the like to wipe ink deposit and paper powder from the surface of the recording head.

Figure 2:
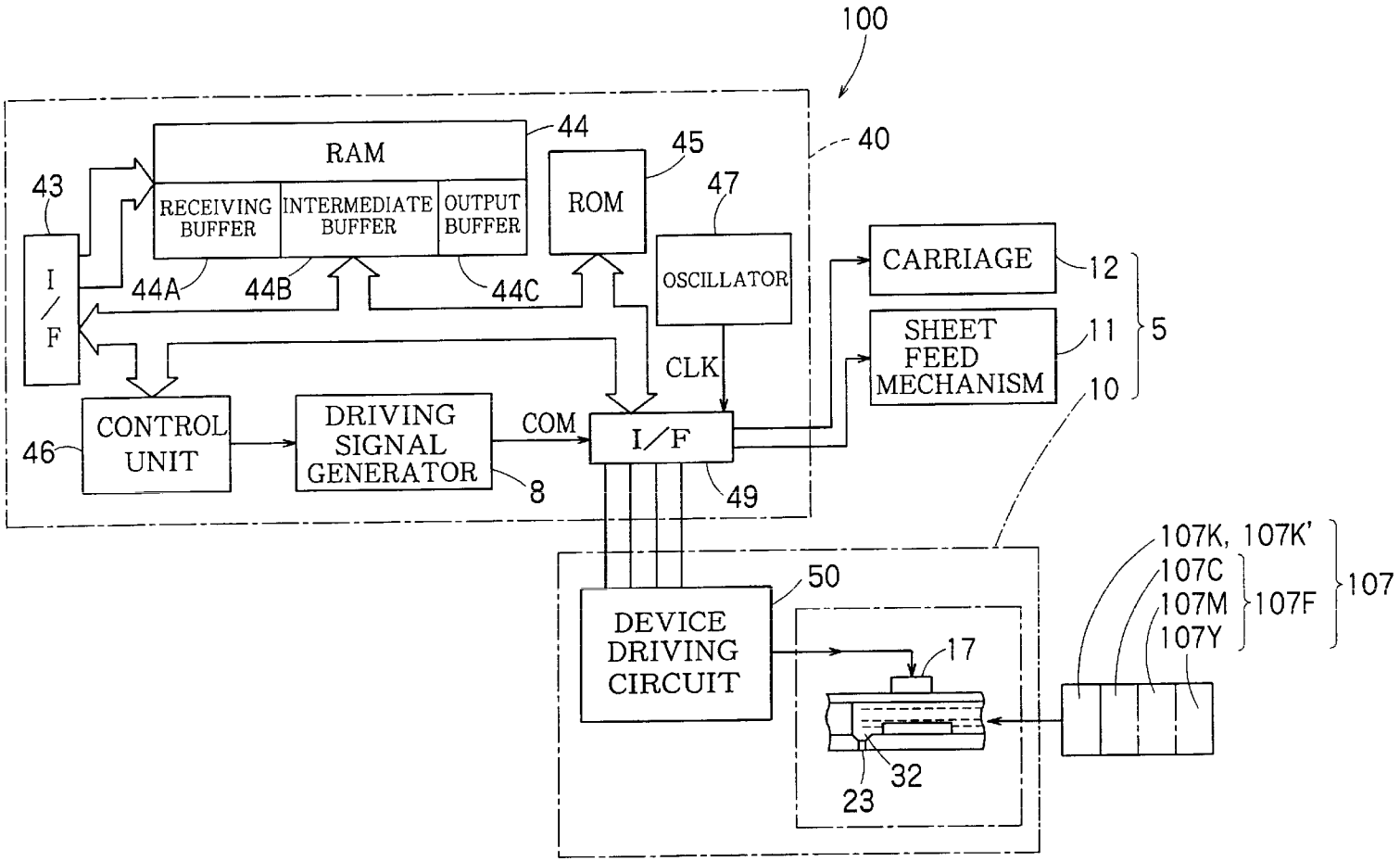
FIG. 2 is a functional block diagram of the ink-jet recording apparatus shown in FIG. 1.

FIG. 2 is a functional block diagram of the printing unit 100.

Referring to FIG. 2, the printing unit 100 includes a print controller 40 and a printing engine 5. The print controller 40 includes an interface 43 that receives recording data including multivalued hierarchical information from a computer, not shown, a RAM 44 for storing data, such as recording data including multivalued hierarchical information, a ROM 45 storing procedures for carrying out data processing operations, a control unit 46 including a CPU and such, an oscillator 47, a driving signal generator 8 that generates a driving signal COM for driving the recording head 10, and an interface 49 for sending print data developed in dot-pattern data and driving signals to the print engine 5.

Recording data including multivalued hierarchical information provided by the computer is received through the interface 43 and is held by a receiving buffer 44A. The recording data held by the receiving buffer 44A is subjected to command analysis and is transferred to an intermediate buffer 44B. The intermediate buffer 44B holds recording data of an intermediate format obtained by converting the recording data into intermediate codes by the control unit 46. The control unit 46 carries out procedures for adding print positions of characters, types of modification, size and font address. Then, the control unit analyzes the recording data held by the intermediate buffer 44B, and gives binary dot pattern data obtained by coding hierarchical data to an output buffer 44C. The output buffer 44C holds the binary dot pattern data.

When dot pattern data for the operation of the recording head 10 for one scanning cycle is obtained, the dot pattern data is transferred through the interface 49 to the recording head 10 in a serial transfer mode. After the dot pattern data for one scanning cycle has been sent out from the output buffer 44C, the contents of the intermediate buffer 44B are erased and recording data for the next scanning cycle is converted into intermediate codes.

The print engine 5 includes the recording head 10, the sheet feed mechanism 11 and the carriage driving mechanism 12. The sheet feed mechanism 11 feeds a recording medium, such as a recording paper sheet, successively. The carriage driving mechanism 12 moves the recording head 10 for scanning.

The recording head 10 jets ink drops through nozzle openings at predetermined time points. A driving signal COM produced by the driving signal generator 8 is sent through the interface 49 to a device driving circuit 50 included in the recording head 10.

Waveform of Driving Signal and Configuration of Driving Signal Generating Circuit 8

Figure 3:
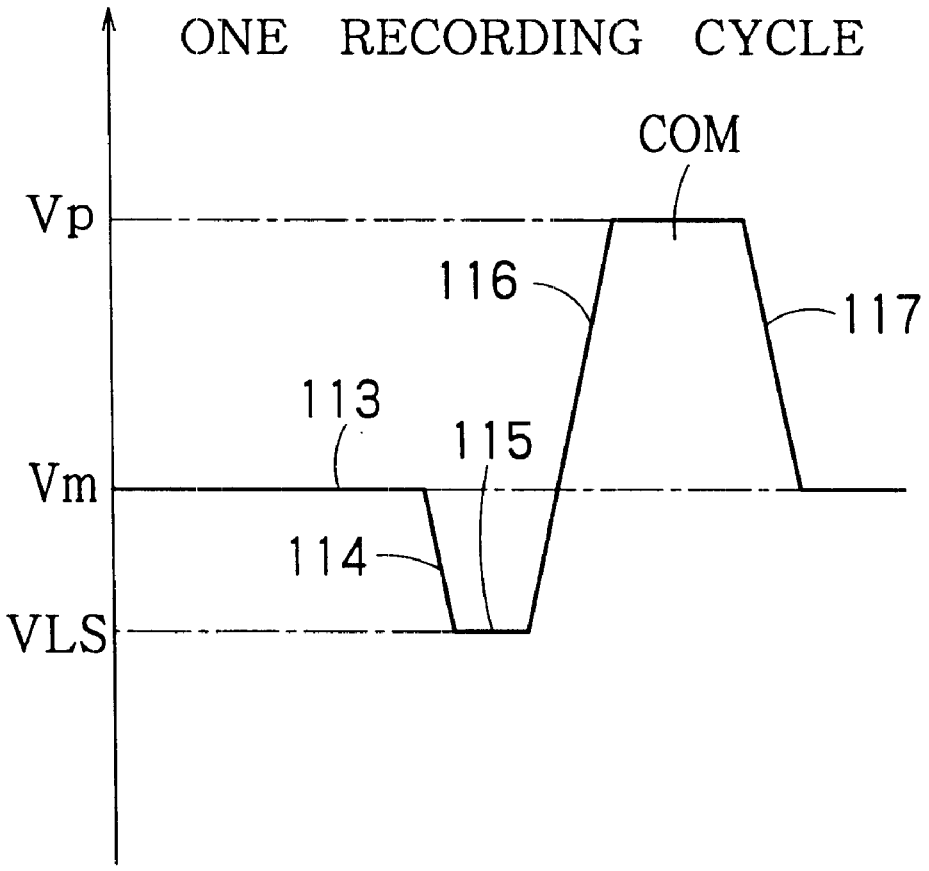
FIG. 3 is a waveform diagram of a driving signal used by the ink-jet recording apparatus shown in FIG. 1.

A driving pulse forming the driving signal COM will be described with reference to FIG. 3. Referring to FIG. 3, the driving signal COM for actuating a piezoelectric vibrator 17 (FIG. 2) remains at an intermediate potential Vm for a predetermined time (hold pulse 113), falls linearly to a minimum potential VLS (first signal/discharge pulse 114), remains at the minimum potential VLS (second signal/hold pulse 115), rises linearly to a maximum potential VP and remains at the maximum potential VP for a predetermined time (third signal/charging pulse 116), and then falls to the intermediate potential Vm (fourth signal/discharge pulse 117).

When the driving signal shown in FIG. 3 is applied to a pressure generator 17 (FIG. 4), a vibrating plate 36 (FIG. 4) is kept in a bent state for the predetermined time by the hold pulse 113 and is lengthened by the discharge pulse 114, so that a pressure chamber 310 is filled up with an ink. The vibrating plate 36 is kept in a lengthened state for a predetermined time by the hold pulse 115. The vibrating plate 36 is caused to bend greatly so as to be convex toward the pressure chamber 310 by the charging pulse 116 to jet an ink drop through a nozzle opening 23 (FIG. 4).

Figures 5A, 5B, 5C:
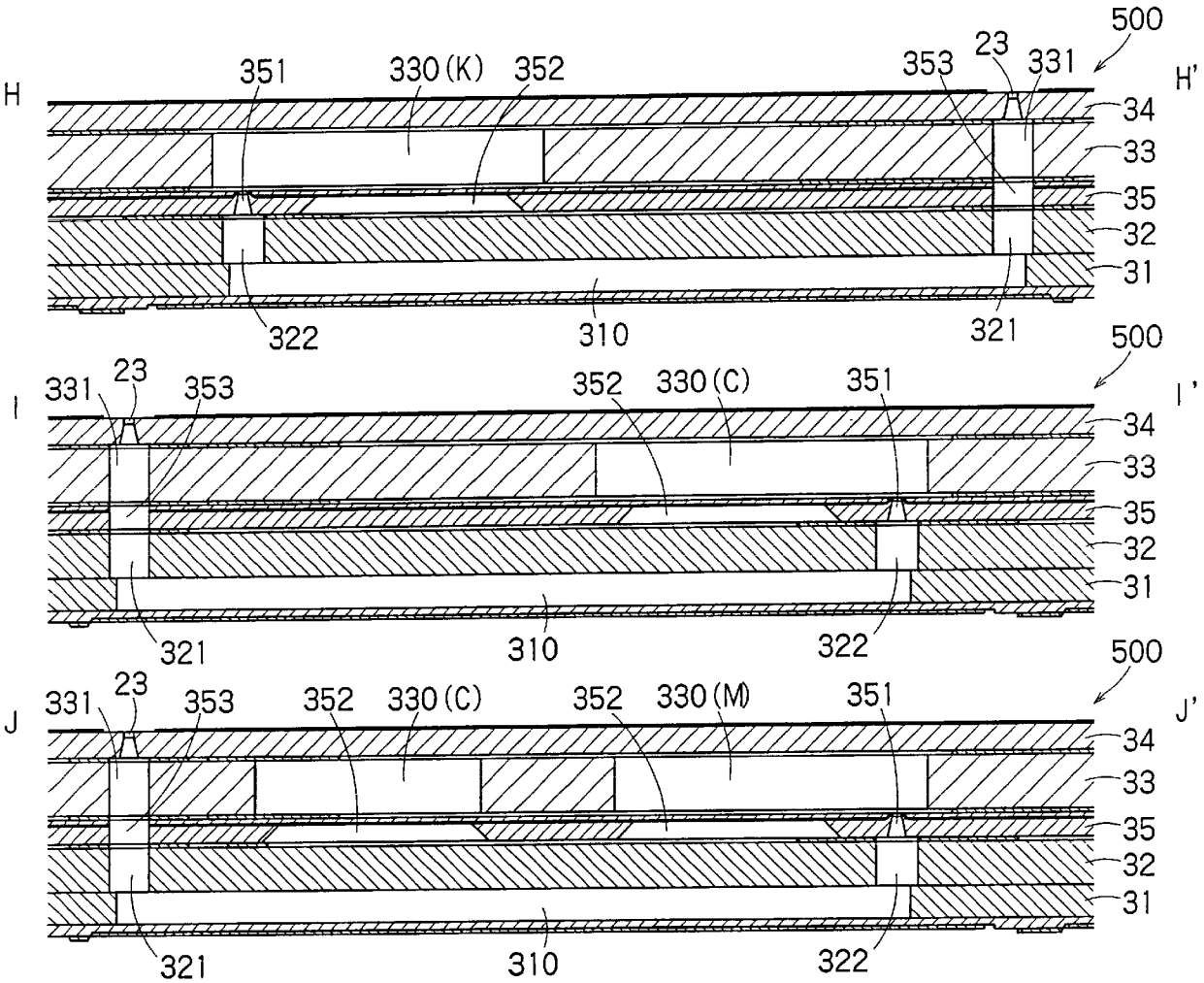
FIGS. 5A, 5B and 5C are sectional views of the ink-jet recording head shown in FIG. 4 taken on lines passing different pressure chambers, respectively.
Figure 6:
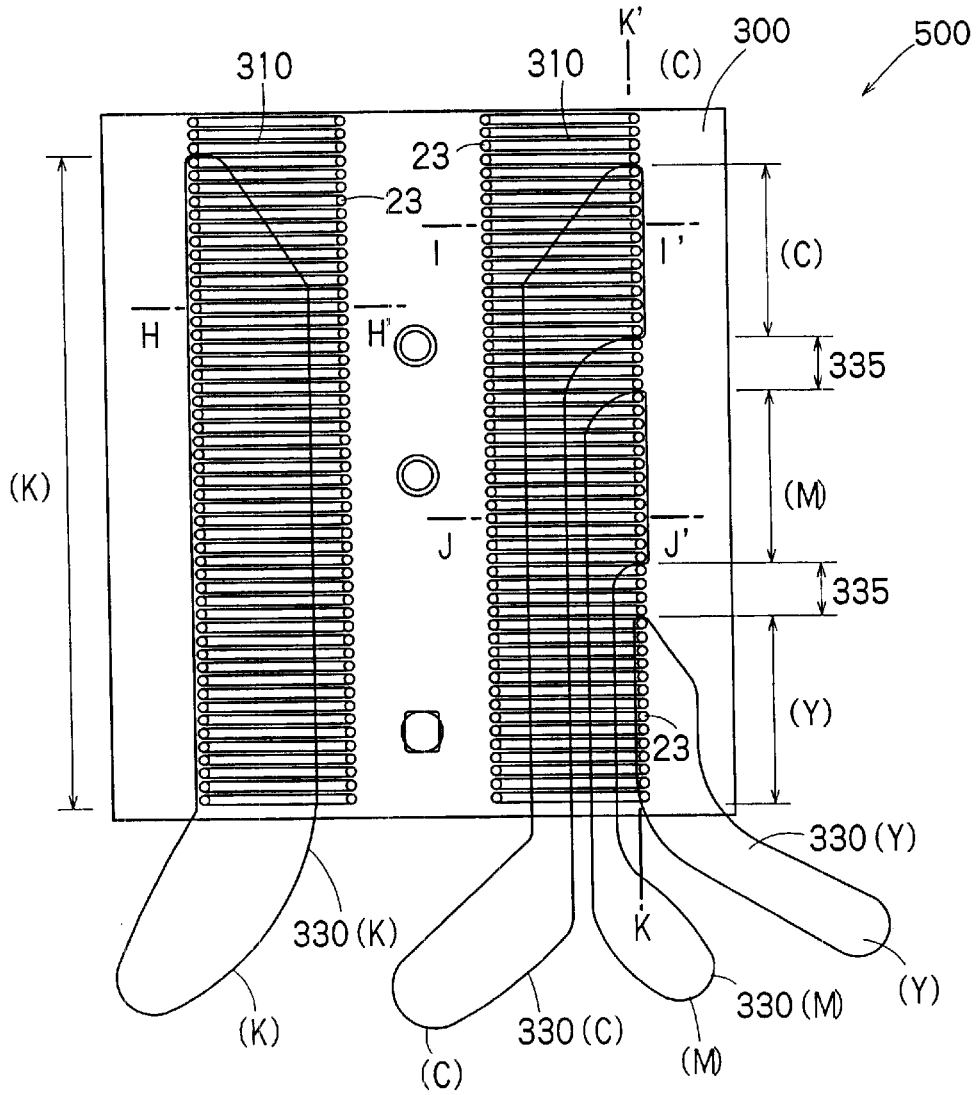
FIG. 6 is a plan view showing the positional relation between pressure chambers, nozzle openings and common ink chambers in the ink-jet recording head shown in FIG. 4.
Figure 7:
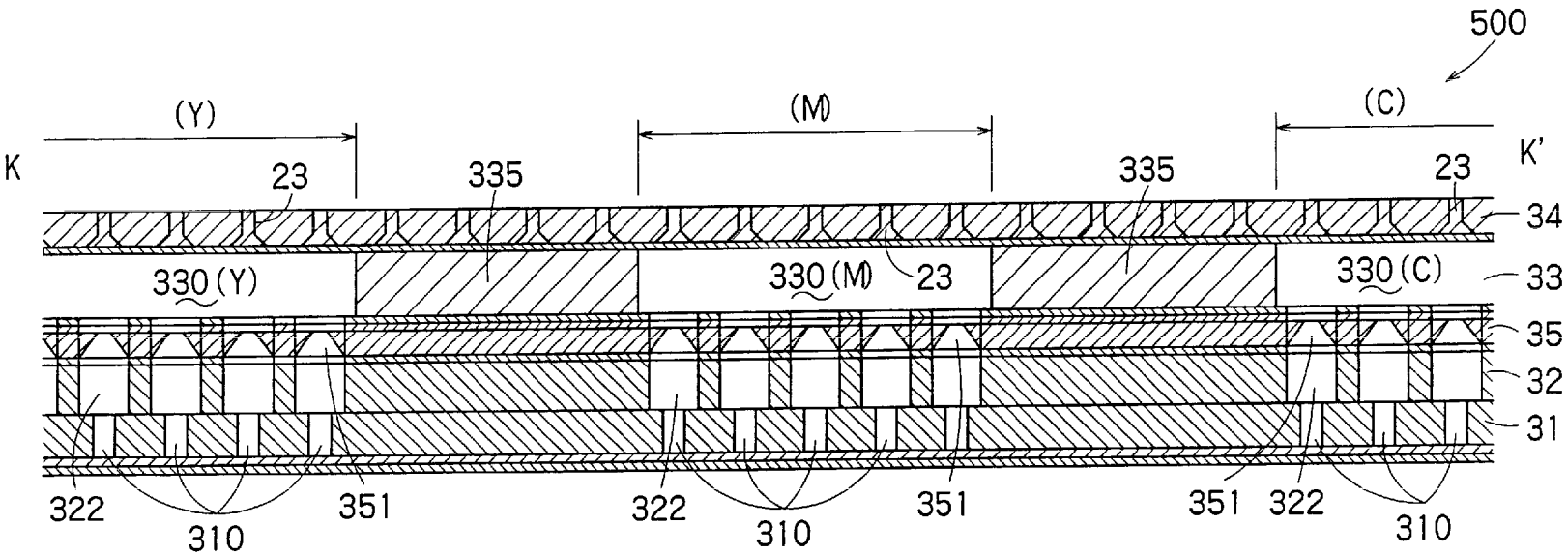
FIG. 7 is a sectional view taken on line corresponding to a row of nozzles in the ink-jet recording head shown in FIG. 4.

The construction of the ink-jet recording head 500 in the first embodiment will be described with reference to FIGS. 4 to 7. FIG. 4 is a sectional view of an actuator and the associated parts formed on the recording head, FIGS. 5A, 5B and 5C are sectional views of the ink-jet recording head taken on lines passing different pressure chambers (cavities), respectively, FIG. 6 is a plan view showing the positional relation between pressure chambers, nozzle openings and common ink chambers in the ink-jet recording head, and FIG. 7 is a sectional view taken on line corresponding to a row of nozzles in the ink-jet recording head. FIGS. 5A, 5B and 5C are sectional views taken on lines H—H', I—I' and J—J', respectively, in FIG. 6, and FIG. 7 is a sectional view taken on line K—K' in FIG. 6.

Figure 4:
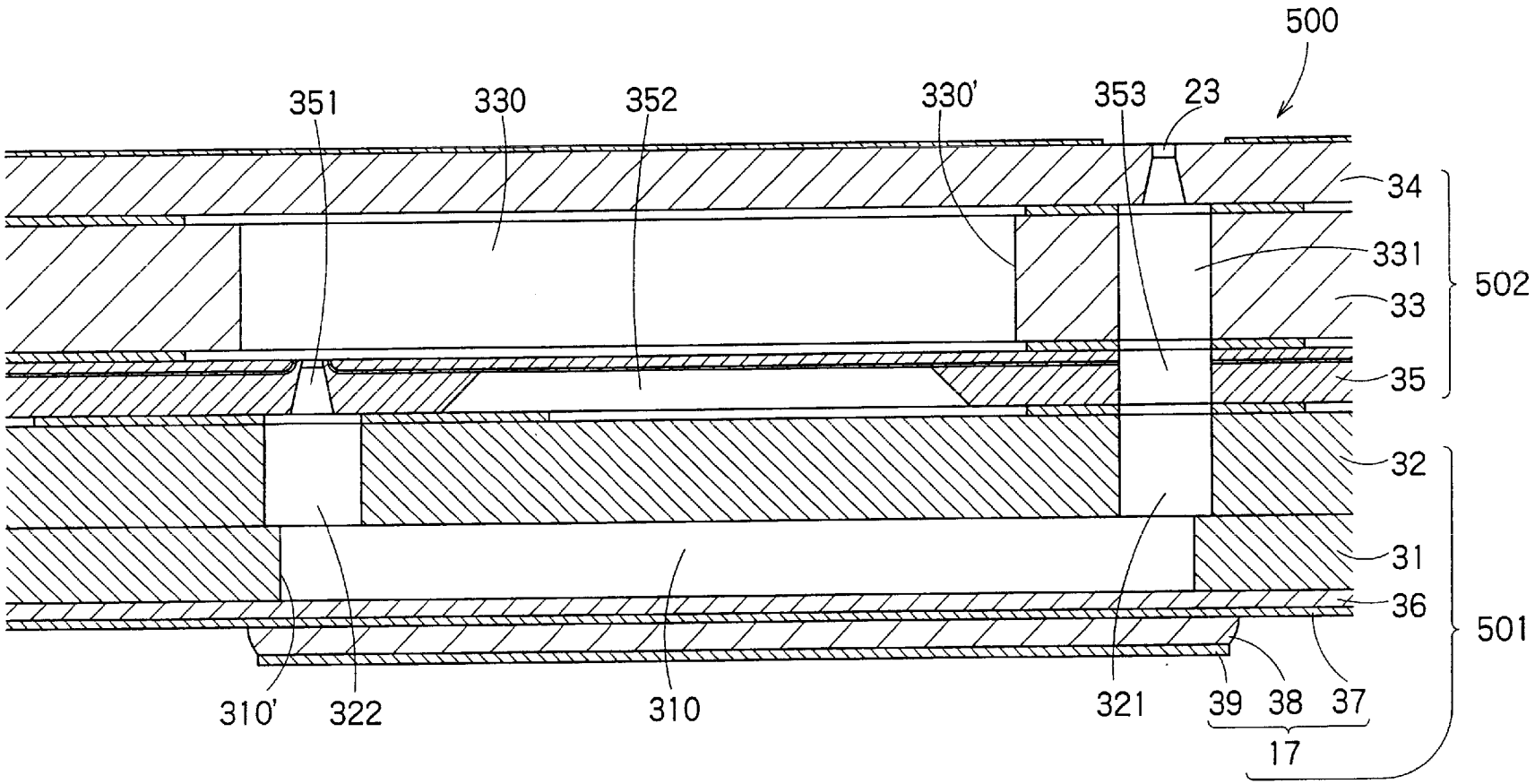
FIG. 4 is a sectional view of the ink-jet recording head in the first embodiment according to the present invention.

Referring to FIG. 4, the recording head 500 has a structure formed by stacking a first plate 31 provided with pressure chamber forming openings 310' for forming pressure chambers 310, a second plate 32 provided with pairs of connecting holes 321 and 322 opening into the opposite ends of the pressure chambers 310, respectively, third plate (reservoir plate) 33 provided with common ink chamber forming holes 330' to be connected to the connecting holes 322 and to form common ink chambers (reservoirs) 330 and ink supply ports 331 connected to the other connecting holes 321, and a fourth plates (nozzle plate) 34 provided with nozzle openings 23 to be connected to the ink supply ports 331.

The vibrating plate 36 and the pressure generators 17 are mounted on the first plate 31, and the first plate 31 and the second plate 32 are combined to form an actuator unit (ACT unit) 501. The third plate (reservoir plate) 33 provided with the common ink chambers 330 and the ink supply ports 331, the fourth plate (nozzle plate) 34 provided with the nozzle openings 23, and a fifth plate (ink supply plate) 35 are combined to form a passage unit 502.

The fifth plate 35 (ink supply plate) is sandwiched between the second plate 32 and the third plate 33. Openings 352 for forming compliance parts for absorbing the variation of the pressure of the ink in the common ink chambers 330 by reducing the thickness of a wall defining the common ink chambers 330 are formed in portions of the fifth plate 35 overlapping the common ink chambers 330. Through holes 351 and 353 are formed in portions of the fifth plate 35 where the common ink chambers 330 of the third plate 33 and the connecting holes 322 of the second plate overlap each other, and the ink supply ports 331 of the third plate 33 and the connecting holes 321 of the second plate 32 overlap each other.

Piezoelectric vibrators as the pressure generators 17 are placed on the outer surface of the first plate 31. The pressure generator 17 and the vibrating plate 36 form a flexural vibration type actuator. The vibrating plate 36 is vibrated. When the pressure chamber 310 is contracted to apply pressure to the ink contained in the pressure chamber 310, the ink contained in the pressure chamber 310 is forced to flow through the connecting hole 321 formed in the second plate 32, the through hole 353 formed in the fifth plate 35 and the ink supply port 331 formed in the third plate 33 and is jetted through the nozzle opening 23 formed in the fourth plate 34. When the pressure chamber 310 is expanded, the ink contained in the common ink chamber 330 flows through the through hole 351 formed in the fifth plate 35 and the connecting hole 322 formed in the second plate 32 into the pressure chamber 310.

As shown in FIGS. 5A, 5B, 5C and 6, the pressure chambers 310 of the recording head 500 are arranged in two rows. The pressure chambers 310 arranged in two rows are driven by a single actuator unit.

In this embodiment, the pressure chambers 310 belonging to the same row and the corresponding nozzle openings 23 are divided into two or more groups respectively for the inks of different colors. First ends of the pressure chambers 310 of a first group are connected to the common ink chamber 330(C) containing a cyan ink, first ends of the pressure chambers 310 of a second group are connected to the common ink chamber 330(M) containing a magenta ink and first ends of the pressure chambers 310 of a third group are connected to the common ink chamber 330(Y) containing an yellow ink. Second ends of the pressure chambers 310 are connected to the nozzle openings 23 for jetting those color inks, respectively. The color inks are supplied from ink cartridges, not shown, to the common ink chambers 330(C), 330(M) and 330(Y).

When dividing the row of the pressure chambers 310 and the row of the nozzle openings 23 into three sections for the three color groups, the adjacent groups are separated by partition walls 335 of a predetermined thickness serving also as side walls defining the common ink chambers 330 as shown in FIGS. 6 and 7. Thus, the common ink chamber 330 is not affected by a pressure variation in the common ink chamber 330 adjacent thereto.

As obvious from FIG. 6, a first one of the two rows of the pressure chambers 310 in this recording head 500 is divided into three sections for three groups of the pressure chambers 310 for the cyan, the magenta and the yellow ink, and all the pressure chambers 310 on a second row are used for the black (K) ink. Therefore, ends of the pressure chambers 310 on the second row on one side of the second row are connected to the common ink chamber 330(K) and ends of the same on the other side of the second row are connected to the nozzle openings 23 for the black ink. The black ink is supplied from an ink cartridge, not shown, to the common ink chamber 330(K).

As mentioned above, the recording head 500 is formed by stacking the actuator unit 501 having the first plate 31 defining the pressure chambers 310 and the passage unit 502 having the third plate 33 defining the common ink chambers 33 and the ink supply ports 331. Therefore, the units 501 and 502 can be fabricated, for example, by burning plates of a ceramic material and the recording head provided with a plurality of pressure chambers arranged in rows extending in the feed direction can be easily fabricated at a low cost.

The design of the recording head can be simply changed by changing the design of either the actuator unit 501 or the passage unit 502 or by changing only the design of some of the component plates of each unit.

Since the pressure chambers 310 and the common ink chambers 330 are defined by the different plates, respectively, i.e., since the pressure chambers 310 and the common ink chambers 330 are included in different planes, respectively, the plates can be stacked in a three-dimensional structure as shown in FIG. 6. Consequently, the recording head can be formed in a small size.

The row of the pressure chambers extending in the feed direction is divided into the groups of the pressure chambers, and the passage unit 502 has the common ink chambers 330 for supplying the different inks to the groups of the pressure chambers 310, respectively. The full color printing recording head can be formed in a small size.

Second Embodiment

Figure 8:
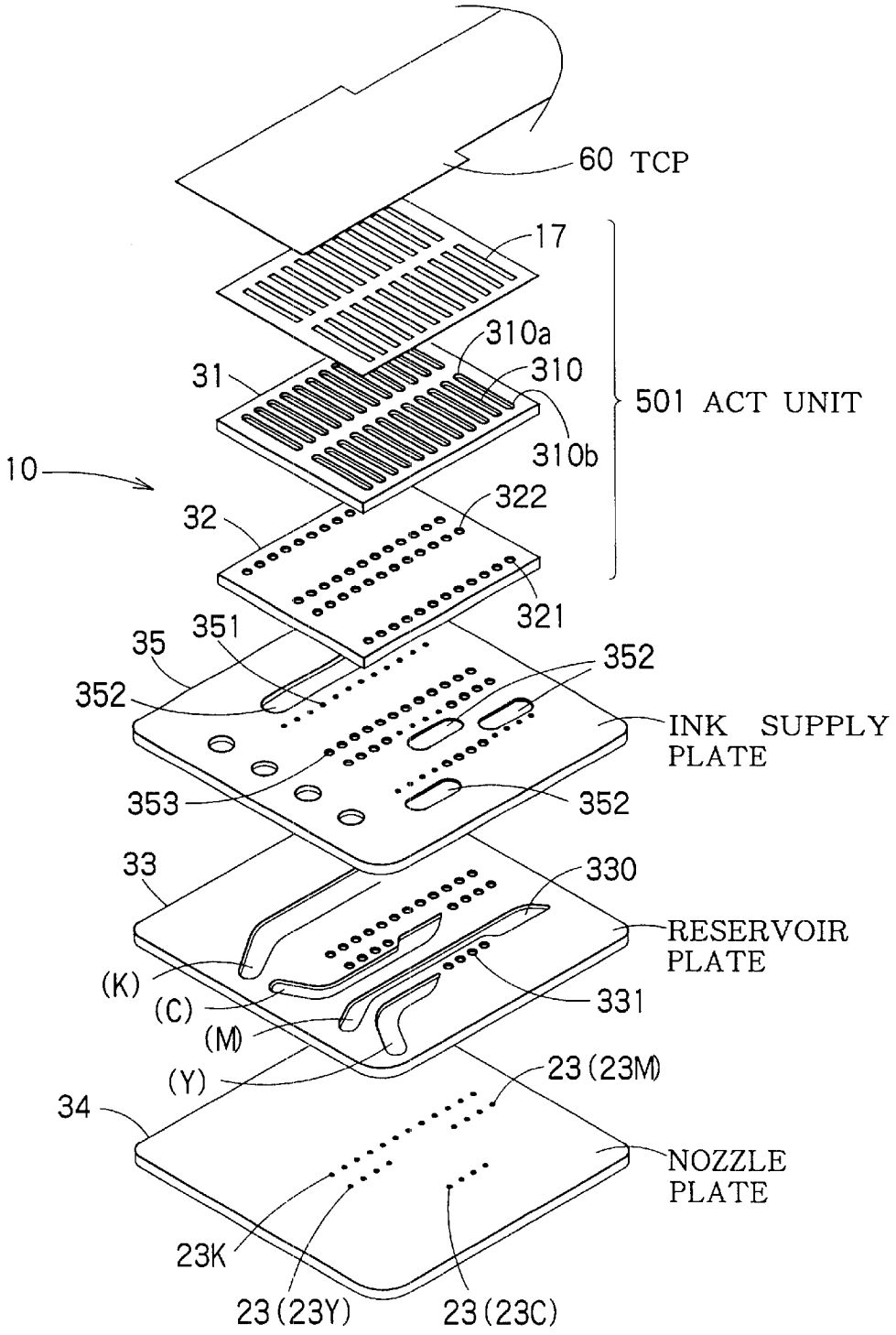
FIG. 8 is an exploded perspective view of plates that are stacked to form an ink-jet recording head in a second embodiment according to the present invention.
Figures 9A, 9B, 9C:
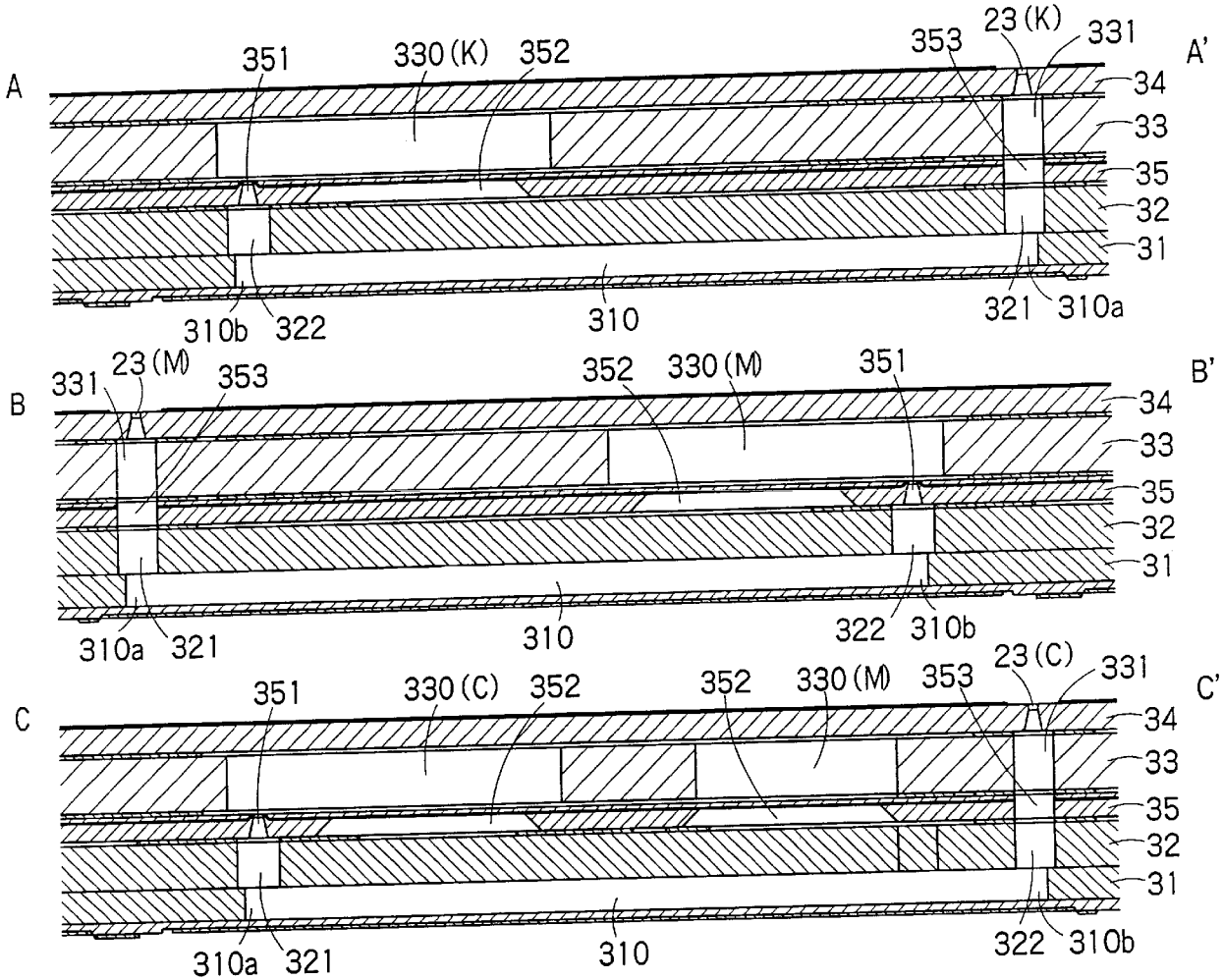
FIGS. 9A, 9B and 9C are sectional views taken on lines passing different pressure chambers in the ink-jet recording head shown in FIG. 8, respectively.
Figure 10:
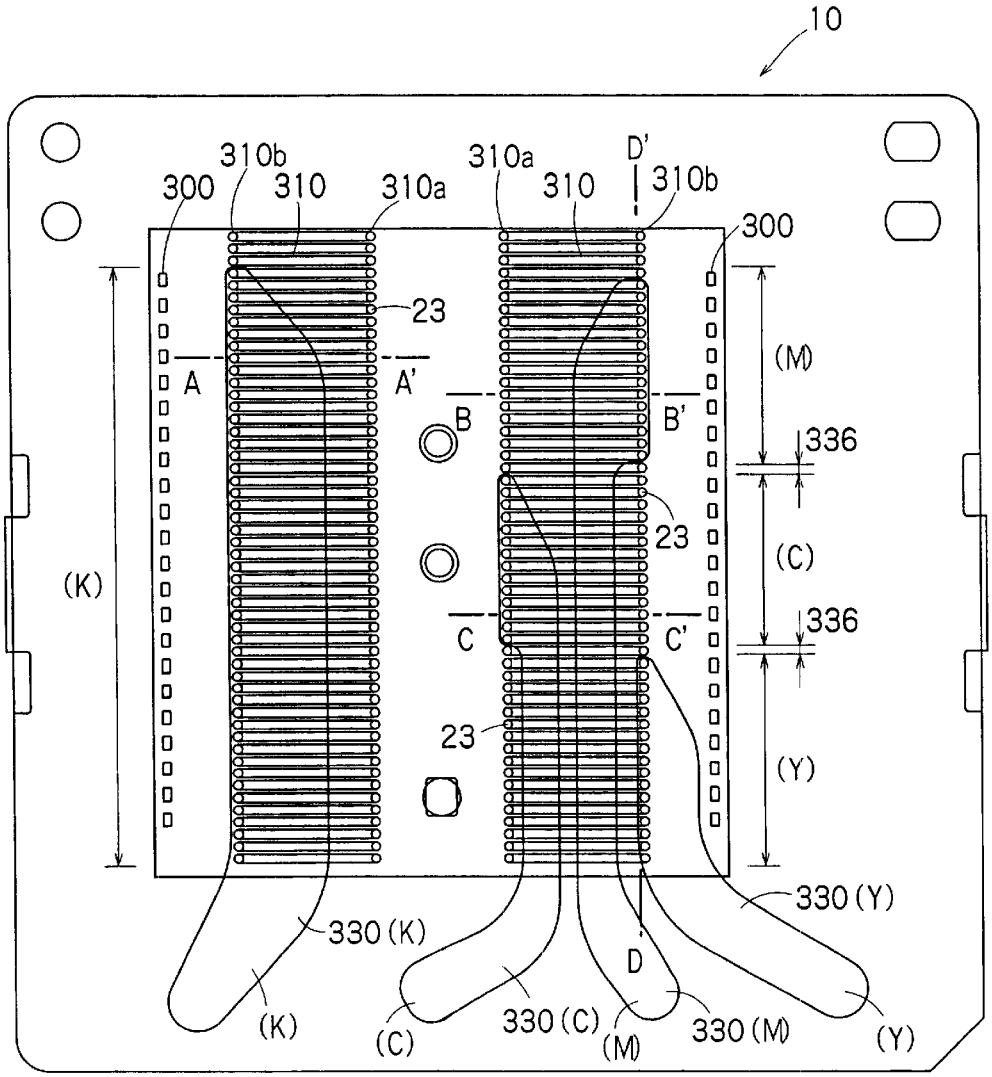
FIG. 10 is a plan view showing the positional relation between pressure chambers, nozzle openings and common ink chambers in the ink-jet recording head shown in FIG. 8.
Figure 11:
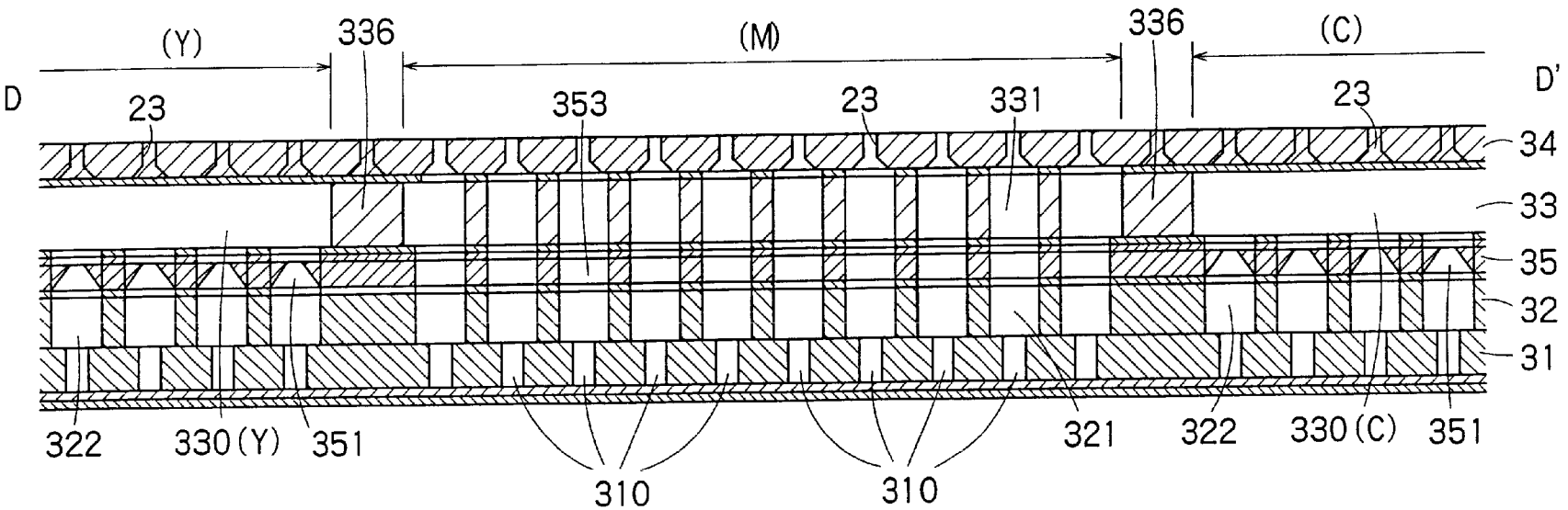
FIG. 11 is a sectional view taken on line corresponding to a row of nozzles in the ink-jet recording head shown in FIG. 8.

An ink-jet recording head in a second embodiment according to the present invention will be described hereinafter. The construction of the ink-jet recording head 10 in the second embodiment will be described with reference to FIGS. 8, 9A, 9B, 9C 10 and 11. FIG. 8 is an exploded perspective view of plates that are stacked to form the ink-jet recording head 10, FIGS. 9A, 9B and 9C are sectional views taken on lines passing different pressure chambers (cavities) in the ink-jet recording head 10 shown in FIG. 8, respectively, FIG. 10 is a plan view showing the positional relation between pressure chambers, nozzle openings and common ink chambers in the ink-jet recording head shown in FIG. 8, and FIG. 11 is a sectional view taken on line corresponding to a row of nozzles in the ink-jet recording head shown in FIG. 8. FIGS. 9A, 9B and 9C are sectional views taken on lines A—A', B—B' and C—C', respectively, in FIG. 10, and FIG. 11 is a sectional view taken on line D—D' in FIG. 10.

The ink-jet recording head in the second embodiment is basically the same in construction as the recording head in the first embodiment previously described with reference to FIGS. 4 to 7. Only the positional relation between pressure chambers 310, nozzle openings 23 and common ink chambers 330 included in the recording head 10 is different from that in the recording head in the first embodiment and hence parts of the recording head 10 like or corresponding in function to those of the recording head in the first embodiment are denoted by the same reference characters. Reference will be made to FIGS. 4 and 8 in explaining an actuator included in the recording head 10 in the second embodiment.

Referring to FIG. 8, the recording head 10 has, similarly to the recording head 500 in the first embodiment, a structure formed by stacking a first plate 31 provided with pressure chamber forming openings 310' for forming pressure chambers 310, a second plate 32 provided with pairs of connecting holes 321 and 322 opening into first ends 310a and second ends 310b of the pressure chambers 310, respectively, a third plate 33 provided with common ink chamber forming holes 330' to be connected to the connecting holes 322 and to form common ink chambers 330 and ink supply ports 331 to be connected to the other connecting holes 321, and a fourth plates 34 provided with nozzle openings 23 to be connected to the ink supply ports 331. The plates 31, 32, 33 and 34 are stacked and bonded together with an adhesive or hot melt adhesive films.

A fifth plate 35 of three-layer structure having three layers is sandwiched between the second plate 32 and the third plate 33. Recesses 352 for forming compliance parts for absorbing the variation of the pressure of the ink in the common ink chambers 330 by reducing the thickness of portions of a wall defining the common ink chambers 330 are formed by removing portions of one of the three layers of the fifth plate 35 overlapping the common ink chambers 330. Through holes 351 and 353 are formed in portions of the fifth plate 35 where the common ink chambers 330 of the third plate 33 and the connecting holes 322 of the second plate overlap each other, and the ink supply ports 331 of the third plate 33 and the connecting holes 321 of the second plate 32 overlap each other.

Piezoelectric vibrators as pressure generators (pressure producing devices) 17, are formed on the outer surface of the first plate 31. The piezoelectric vibrators have a thin sheet of zirconia ($ZrO_2$)having a thickness on the order of 6 Am and serving as a vibrating plate (elastic plate) 36. The vibrating plate 36 i put on the first plate 31 so as to cover the pressure chambers 10. A common electrode 37 is formed on a surface of the vibrating plate 36. A piezoelectric layer 38 for PZT is formed on a surface of the common electrode 37. Driving electrodes 39 of a comparatively soft metal, such as Au, is formed on a surface of the piezoelectric layer 38.

The driving electrodes 39 and the pressure chambers 310 are in one-to-one correspondence. Signals are given through a tape carrier package (TCP) 60 shown in FIG. 8 to the driving electrodes 39. The pressure generator 17 and the vibrating plate 36 form a flexural vibration type actuator. The pressure generator 17 contracts when charged, so that the volume of the corresponding pressure chamber 310 is reduced to apply pressure to the ink contained in the pressure chamber 310. The pressure generator 17 extends when discharged, so that the pressure chamber 310 is allowed to recover its original volume. When the pressure generator 17 is driven by a predetermined driving signal to vibrate the vibrating plate 36 so that the pressure chamber 310 is contracted to apply pressure to the ink contained therein, the ink contained in the pressure chamber 310 is forced to flow through the connecting hole 321 formed in the second plate 32, the through hole 353 formed in the fifth plate 35 and the ink supply port 331 formed in the third plate 33 and is jetted through the nozzle opening 23 formed in the fourth plate 34.

When the pressure chamber 310 is expanded, the ink contained in the common ink chamber 330 flows through the through hole 351 formed in the fifth plate 35 and the connecting hole 322 formed in the second plate 32 into the pressure chamber 310 to replenish the pressure chamber 310 with the ink.

As shown in FIGS. 8, 9A, 9B, 9C and 10, the pressure chambers 310 of the recording head 10 are arranged in rows at intervals of about 0.2 mm, and the opposite longitudinal ends of the pressure chambers 310 are connected to the common ink chambers 330 and the nozzle openings 23, respectively. The pressure chambers 310 belonging to the same row and the corresponding nozzle openings 23 are divided into two or more groups respectively for the inks of different colors to use two or more color inks for recording. The first ends of the pressure chambers 310 of the groups are connected to the common ink chamber 330(C) containing a cyan ink, the common ink chamber 330(M) containing a magenta ink and the common ink chamber 330(Y) containing an yellow ink, and the second ends of the pressure chambers 310 of the groups are connected to the corresponding nozzle openings 23, respectively.

The common ink chambers 330(C), 330(M) and 330(Y) extend on the recording head 10 from regions in which the pressure chambers 310 are formed to an end of the recording head 10. The color inks are supplied from ink cartridges, not shown, to the common ink chambers 330(C), 330(M) and 330(Y). As shown in FIG. 10, the common ink chambers 330(C), 330(M) and 330(Y) are extended so as to avoid the regions in which terminals 300 for connecting the pressure producing devices 17 to wiring are formed. Therefore, when connecting a wiring board to the terminals 300, the common ink chambers 330(C), 330(M) and 330(Y) are not deformed by force exerted on the recording head 10, and the flatness of the regions in which the terminals 300 are formed are not affected adversely by the common ink chambers 330(C), 330(M) and 330(Y).

In the recording head 10, a first one of the two rows of the pressure chambers 310 is divided into three sections for three groups of the pressure chambers 310 for the cyan, the magenta and the yellow ink, and all the pressure chambers 310 on a second row are used for the black (K) ink. Therefore, ends of the pressure chambers 310 on the second row on one side of the second row are connected to the common ink chamber 330(K) and ends of the same on the other side of the second row are connected to the nozzle openings 23 for the black ink. The black ink is supplied from an ink cartridge, not shown, to the common ink chamber 330(K). The common ink chamber 330(K) is extended so as to avoid the regions in which the terminals 300 for connecting the pressure generators 17 to wiring. Therefore, the common ink chamber 330(K) is not deformed by force exerted on the recording head 10 when connecting the wiring board to the terminals 300, and the flatness of the regions in which the terminals 300 are formed is not affected adversely by the common ink chamber 330(K).

In each color group, all the first ends 310*a* or all the second ends 310*b* of the pressure chambers 310 are connected to the nozzle openings 23. Supposing that all the first ends 310*a* of the pressure chambers 310 of one of the color groups are connected to the nozzle openings 23, all the second ends 310*b* of the pressure chambers 310 of the color group adjacent to the former are connected to the nozzle openings 23.

For example, as shown in FIGS. 9B and 10, the first ends 310*a* of the pressure chambers 310 of the color groups for magenta and yellow on the side of the nozzle openings 23 for the black ink are connected to the corresponding nozzle openings 23, and the second ends 310*b* of the same are connected to the common ink chambers 330. As shown in FIGS. 9C and 10, the first ends 310*a* of the pressure chambers 310 of the color group for cyan between the color groups for magenta and yellow on the side of the nozzle openings 23 for the black ink are connected to the common ink chamber 330 and the second ends 310*b* of the same are connected to the nozzle openings 23. As obvious from the comparative observation of FIGS. 9B and 9C, patterns of openings in the first plate 31 and the second plate 32 for magenta and cyan are the same, and those in the third plate 33, the fourth plate 34 and the fifth plate 35 for magenta and cyan are different from each other.

Thus, in the recording head 10, the nozzle openings 23 for one of the two adjacent color groups and the common ink chamber 330 for the other color group are formed on the same side.

Accordingly, the common ink chambers 330 for the adjacent color groups are not arranged in the feed direction and hence the adjacent color groups do not need to be separated from each other by a thick partition wall, and the adjacent end pressure chambers 310 may be separated from each other by a thin partition wall 336 of about 0.1 mm in thickness that requires the omission of one pressure chamber 310 as shown in FIGS. 10 and 11. Consequently, even if the pressure chambers 310 are divided into the color groups to reduce the number of actuator units and to form the recording head 10 in a small size, the recording head 10 is able to print full color pictures and characters in a high print quality without reducing printing speed because each color group of the recording head 10 includes an increased number of nozzle openings 23.

Since the groups of the nozzles for different color inks are spaced apart, the mixing of different colors that occurs during cleaning can be limited to the least extent.

Since the recording head 10 is formed by stacking the first plate 31 to the fifth plate 35 provided with the predetermined openings, only the patterns of the openings formed in the first to fifth plates 31 to 35 need to be changed to change the connection of the opposite ends 310*a* and 310*b* of the pressure chambers 310 to the common ink chambers 330 and the nozzle openings 23. Thus, the recording head 10 can be easily fabricated at a low cost.

As shown in FIG. 10, in the second embodiment, the common ink chambers 330(C) and 330(M) are formed in regions overlapping the region in which the pressure chambers 310 are formed, and the common ink chamber 330(Y) is formed in a region not corresponding to the region in which the pressure chambers 310 are formed. Accordingly, the common ink chambers 330 can be arranged in a compact arrangement.

Third Embodiment

Figure 12A:
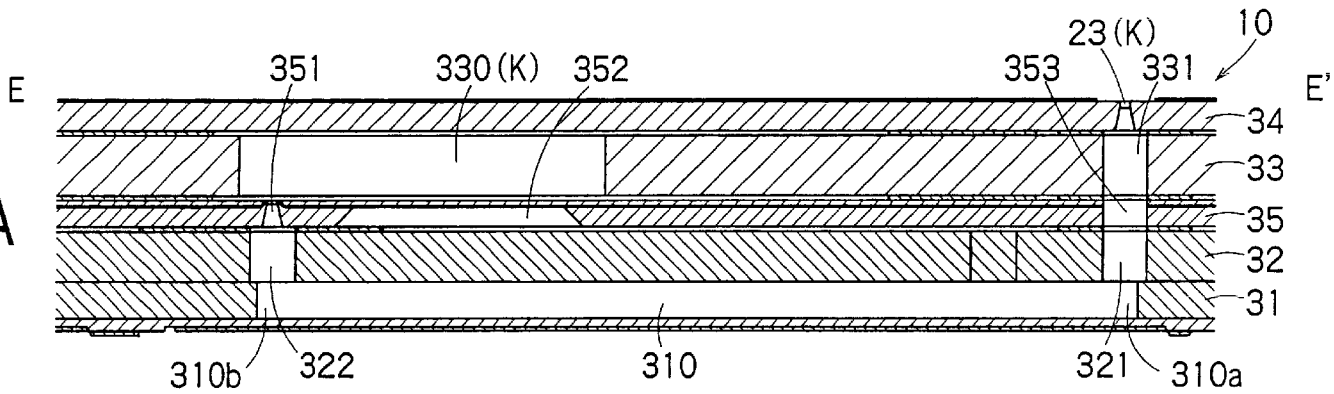
FIGS. 12A and 12B are sectional views of an ink-jet recording head in a third embodiment according to the present invention taken on lines passing different pressure chambers, respectively.
Figure 12B:
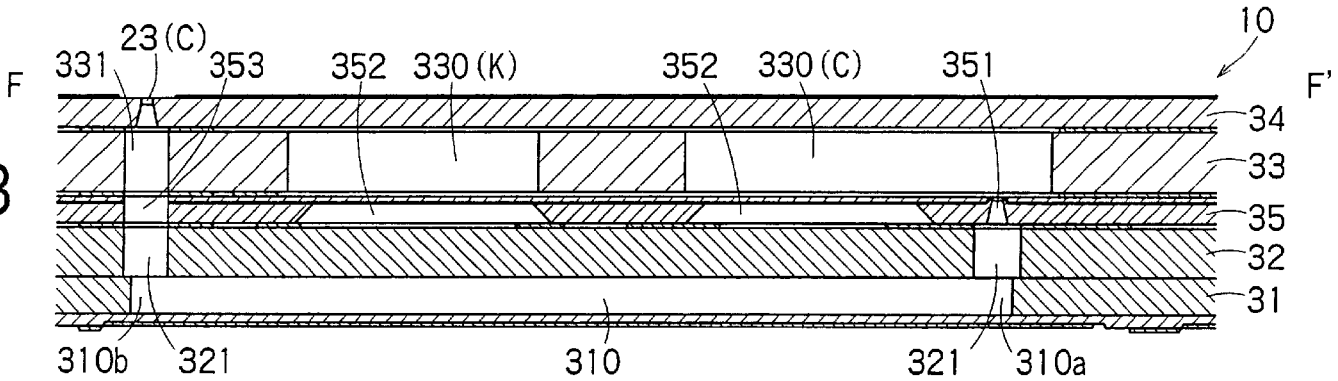
Figure 13:
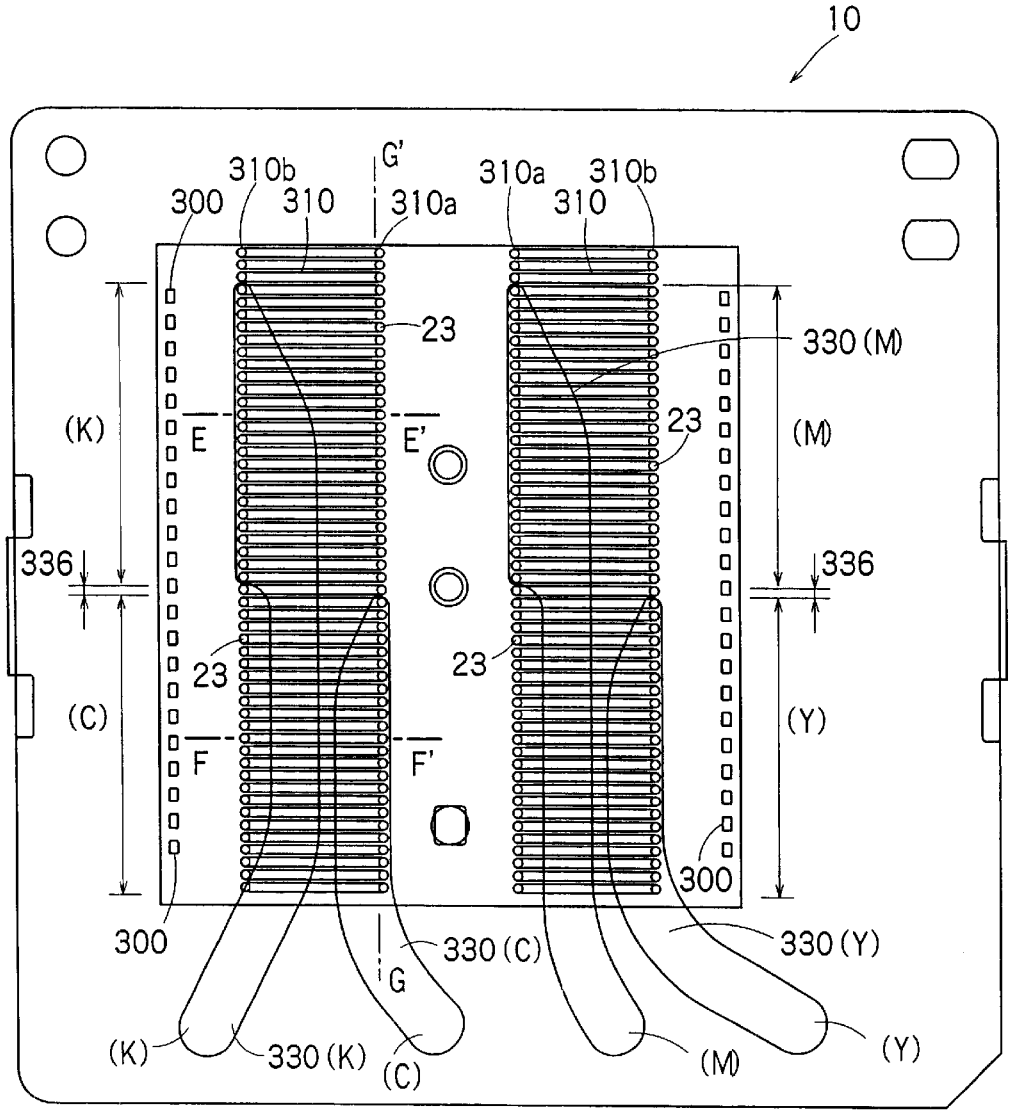
FIG. 13 is a plan view showing the positional relation between pressure chambers, nozzle openings and common ink chambers in the ink-jet recording head in the third embodiment according to the present invention.
Figure 14:
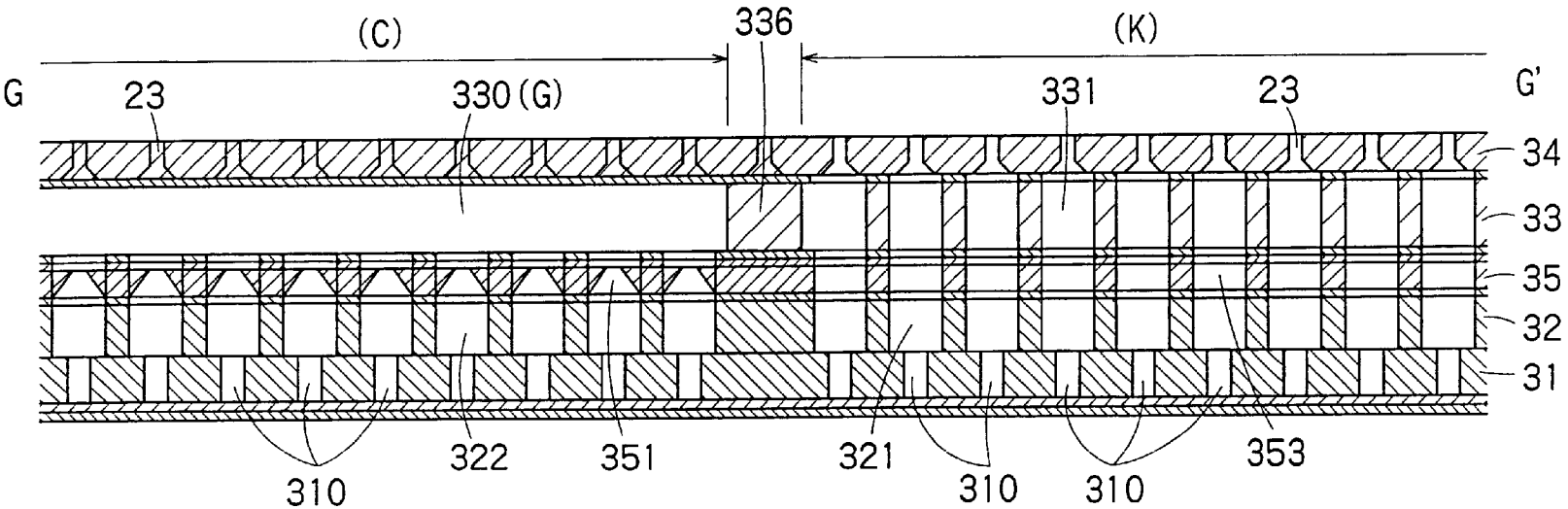
FIG. 14 is a sectional view taken on line corresponding to a row of nozzles in the ink-jet recording head in the third embodiment according to the present invention.

The construction of a recording head 10 in a third embodiment according to the present invention will be described with reference to FIGS. 12A, 12B, 13 and 14. FIGS. 12A and 12B are sectional views of the recording head 10 taken on lines passing different pressure chambers (cavities), respectively, FIG. 13 is a plan view showing the positional relation between pressure chambers, nozzle openings and common ink chambers in the recording head 10 and FIG. 14 is a sectional view taken on line corresponding to a row of nozzles in the recording head 10. FIGS. 12A and 12B are sectional views taken on line E—E' and line F—F' in FIG. 13, respectively, and FIG. 14 is a sectional view taken on line G—G' in FIG. 13.

The ink-jet recording head in the third embodiment is similar in basic construction to the ink-jet recording heads in the first and the second embodiment, except that the positional relation between pressure chambers 310, the nozzle openings 23 and the common ink chambers 330 in the third embodiment is different from those in the first and the second embodiment and hence parts like or corresponding in function to those of the first and the second embodiment are denoted by the same reference characters and the description thereof will be omitted.

Referring to FIGS. 12A, 12B and 13, the pressure chambers 310 of the recording head 10 are arranged in rows, and the opposite ends 310*a* and 310*b* are connected to the common ink chambers 330 and the nozzle openings 23, respectively. The pressure chambers 310 on each row and the corresponding nozzle openings 23 are divided into color groups to use two or more color inks. The opposite ends 310*a* and 310*b* of the pressure chambers 310 of a black (K) group and a cyan (C) group on one of the rows are connected to the common ink chambers 330(K) and 330(C), and the nozzle openings 23 for jetting a black ink and a cyan ink, respectively.

The opposite ends 310*a* and 310*b* of the pressure chambers 310 of a magenta (M) group and an yellow (Y)group on the other row are connected to the common ink chambers 330(M) and 330(Y), and the nozzle openings 23 for jetting a magenta ink and an yellow ink, respectively.

The common ink chambers 330(K), 330(C), 330(M) and 330(Y) of the recording head 10 extend from regions in which the pressure chambers 310 are formed to an end of the recording head 10. Inks are supplied to the common ink chambers 330(K), 330(C), 330(M) and 330(Y) from cartridges, not shown, connected to ends of the common ink chambers 330(K), 330(C), 330(M) and 330(Y). The common ink chambers 330(K), 330(C), 330(M) and 330(Y) are extended so as to avoid regions in which terminals 300 for connecting the pressure generators 17 to wiring are formed. Therefore, when connecting a wiring board to the terminals 300, the common ink chambers 330(K), 330(C), 330(M) and 330(Y) are not deformed by force exerted on the recording head 10, and the flatness of the regions in which the terminals 300 are formed are not affected adversely by the common ink chambers 330(K), 330(C), 330(M) and 330(Y).

In each color group, all the first ends 310*a* or all the second ends 310*b* of the pressure chambers 310 are connected to the nozzle openings 23. Supposing that all the first ends 310*a* of the pressure chambers 310 of one of the color groups are connected to the nozzle openings 23, all the second ends 310*b* of the pressure chambers 310 of the color group adjacent to the former are connected to the nozzle openings 23.

For example, as shown in FIGS. 12A and 13, the first ends 310*a* of the pressure chambers 310 of the black group on the side of the nozzle openings 23 for the magenta and the yellow group are connected to the nozzle openings 23 and the second ends 310*b* of the same are connected to the common ink chamber 330(K). As shown in FIGS. 12B and 13, the first ends 310a of the pressure chambers 310 of the cyan group on the side of the nozzle openings 23 for the magenta and the yellow group are connected to the common ink chamber 330(C) and the second ends 310b of the same are connected to the nozzle openings 23.

As obvious from the comparative observation of FIGS. 12A and 12B, patterns of openings in the first plate 31 and the second plate 32 for black and cyan are the same, and those in the third plate 33, the fourth plate 34 and the fifth plate 35 for black and cyan are different from each other.

Similarly, as shown in FIG. 13, the first ends 310*a* of the pressure chambers 310 for yellow on the side of the nozzle openings 23 for black and cyan are connected to the nozzle openings 23 and the second ends 310*b* of the same are connected to the common ink chamber 330(Y) for yellow. The first ends 310*a* of the pressure chambers 310 for magenta on the side of the nozzle openings 23 for black and cyan are connected to the common ink chamber 330(M) and the second ends 310*b* of the same are connected to the nozzle openings 23.

Thus, in the recording head 10, all the first ends 310*a* and all the second ends 310*b* of the pressure chambers 310 of each color group are connected to the common ink chamber 330 and the nozzle openings 23, respectively. Supposing that all the first ends 310*a* and all the second ends 310*b* of the pressure chambers 310 of one of the color groups are connected to the nozzle openings 23 and the common ink chamber 330, respectively, all the second ends 310*b* and all the first ends 310*a* of the pressure chambers 310 of the color group adjacent to the former are connected to the nozzle openings 23 and the common ink chamber 330, respectively. Therefore, the common ink chamber 330 for one of the adjacent color groups is formed on the side of the nozzle openings 23 for the color group adjacent to the former.

Therefore, the common ink chambers 330 for the adjacent color groups are not arranged side by side in the regions in which the ends of the pressure chambers 310 are arranged. Consequently, the respective, adjacent end pressure chambers 310 of the adjacent color groups do not need to be separated by a thick partition wall, and the same pressure chambers may be separated from each other by a thin partition wall 336 that requires the omission of one pressure chamber 310 as shown in FIGS. 13 and 14. Therefore, even if the pressure chambers 310 are divided into the color groups to reduce the number of actuator units and to form the recording head 10 in a small size, the recording head 10, similarly to that in the second embodiment, is able to print full color pictures and characters in a high print quality because each color group of the recording head 10 includes an increased number of nozzle openings 23.

Fourth Embodiment

An ink-jet recording head in a fourth embodiment according to the present invention will be described with reference to the accompanying drawings.

Figure 15:
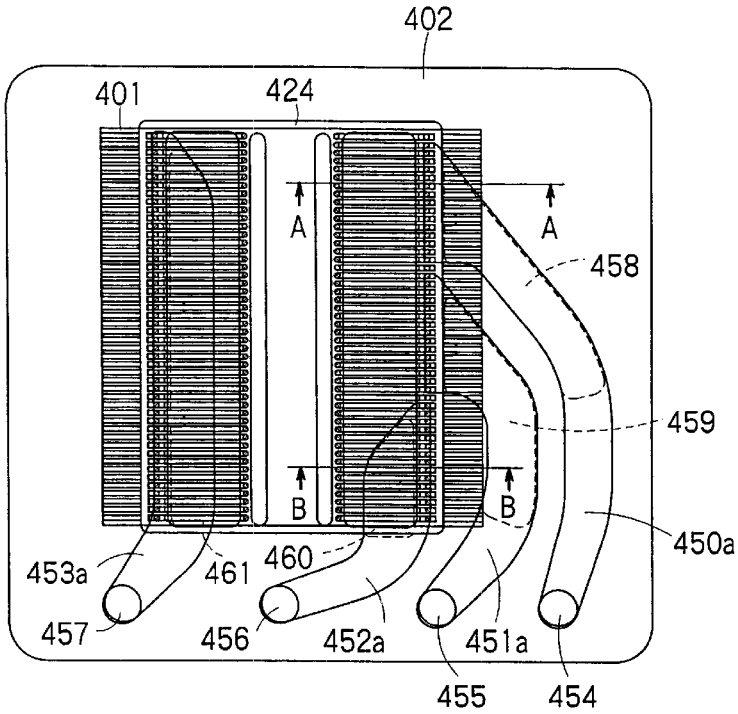
FIG. 15 is a plan view of an ink-jet recording head in a fourth embodiment according to the present invention.

FIG. 15 shows the recording head in the fourth embodiment. An actuator unit 401 for applying pressure to inks is put on and bonded to a passage unit 402, which will be described later.

Figure 16:
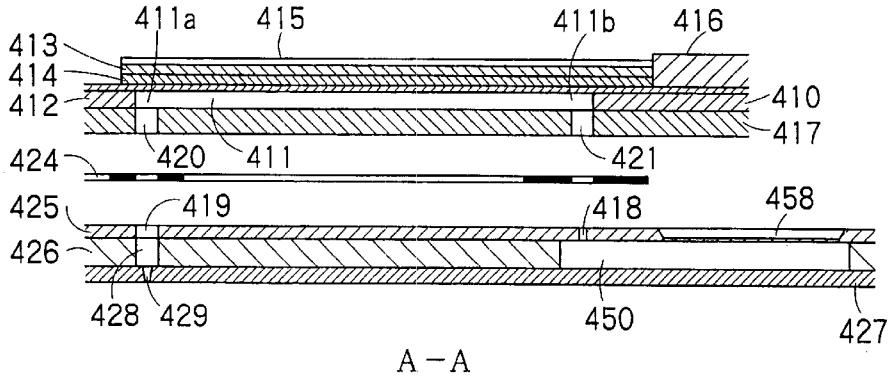
FIG. 16 is a sectional view of the ink-jet recording head shown in FIG. 15 taken on line longitudinally passing a pressure chamber provided with a reservoir extending from the outside of an actuator unit, in which the actuator unit and a passage unit are separated.
Figure 17:
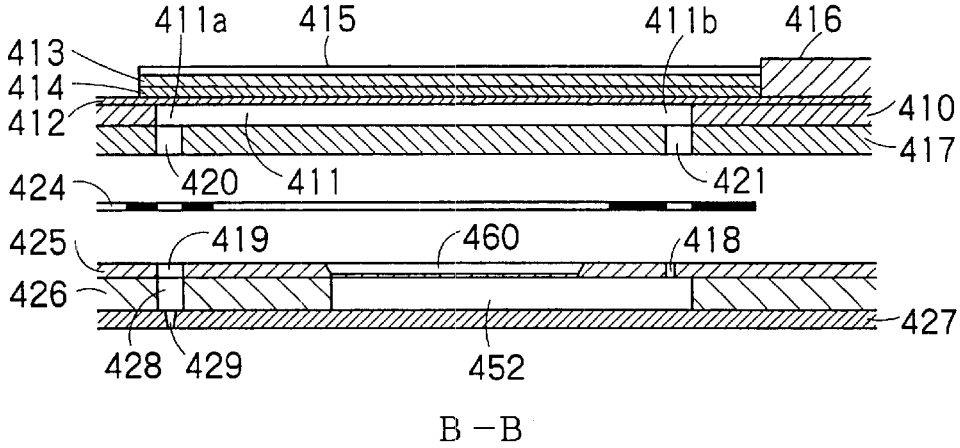
FIG. 17 is a sectional view of the ink-jet recording head shown in FIG. 15 taken on line longitudinally passing a pressure chamber provided with a reservoir extending from the inside of the actuator unit, in which the actuator unit and the passage unit are separated.
Figure 18:
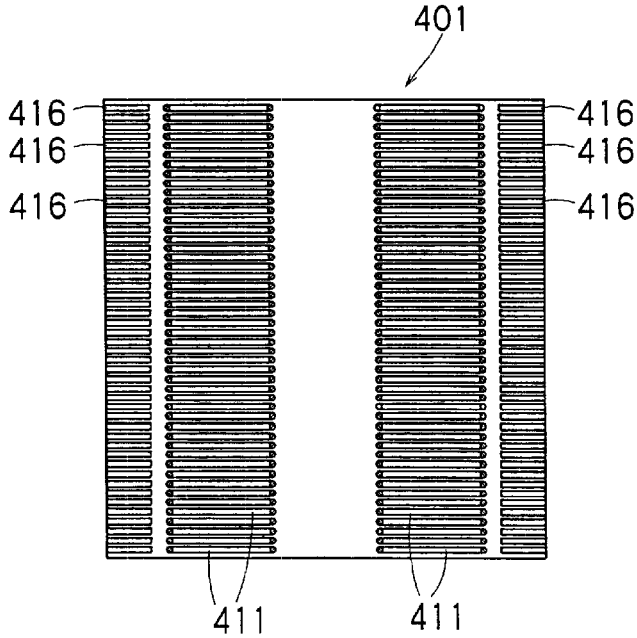
FIG. 18 is a view showing a pressure chamber array in the actuator unit of the ink-jet recording head shown in FIG. 15.

FIG. 16 is a sectional view of the ink-jet recording head shown in FIG. 15 taken on line longitudinally passing a pressure chamber provided with a reservoir (common ink chamber) extending from the outside of an actuator unit, in which the actuator unit and the passage unit are separated, FIG. 17 is a sectional view of the ink-jet recording head shown in FIG. 15 taken on line longitudinally passing a pressure chamber provided with a reservoir extending from the inside of the actuator unit, in which the actuator unit and the passage unit are separated and FIG. 18 is a view showing a pressure chamber array in the actuator unit.

A spacer 410 shown in FIGS. 16 and 17 is a ceramic plate, such as a zirconia ($ZrO_2$) plate of a thickness suitable for defining pressure chambers 411 of a depth on the order of 100 $\mu$m. Each pressure chamber 411 has a first end 411a and a second end 411*b*.

An elastic plate (vibrating plate) 412 is, for example, a thin sheet of a material, such as zirconia, having a thickness of 7 $\mu$m and capable of exerting sufficient bonding force when fired together with the spacer 410 and of being elastically deformed by the flexural vibration of a piezoelectric vibrator 413.

The piezoelectric vibrators 413 are formed by applying a green sheet of a piezoelectric material to the surface of a lower electrode 414 attached to a surface of the elastic plate 412 opposite to the pressure chambers 411, sintering the green sheet to form a piezoelectric layer, and forming an upper electrode 415 on a surface of the piezoelectric layer. Indicated at 416 is a terminal unit through which driving signals are given to the lower electrodes 414 and the upper electrode 415.

A connecting plate 417 is provided with connecting holes 420 and 421 for connecting the pressure chambers 411 to ink supply ports 418 and nozzle openings 429. The connecting plate 417 is, for example, a ceramic plate of zirconia ($ZrO_2$) having a thickness on the order of 150 $\mu$m.

The component members 410, 412 and 417 are fixedly united together by firing to form the actuator unit 401 shown in FIG. 18.

Figure 19:
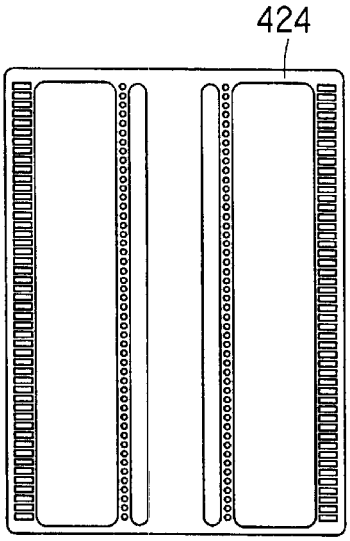
FIG. 19 is a plan view of an adhesive film for bonding together the actuator unit and the passage unit of the ink-jet recording head shown in FIG. 15.
Figure 21:
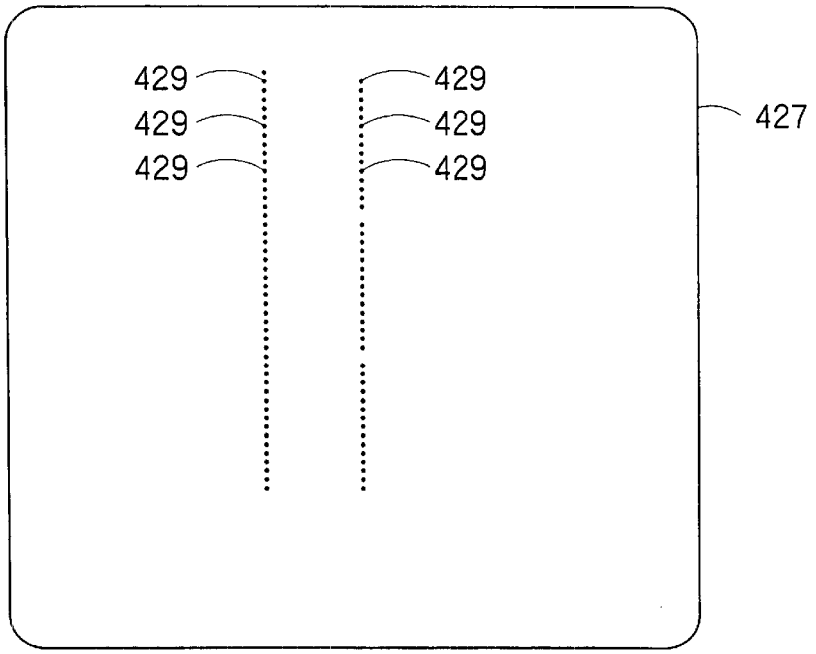
FIG. 21 is a plan view of a nozzle plate included in the ink-jet recording head shown in FIG. 15.

Referring to FIG. 15, the passage unit 402 serves as a base plate to which the actuator unit 401 is attached. The ink passage unit is formed by laminating an ink supply port plate 425 to be bonded to the actuator unit 401 with an adhesive film 424 of polyolefin having a thickness, for example, on the order of 20 $\mu$m as shown in FIG. 19, a reservoir plate 426, and a nozzle plate 427 shown in FIG. 21.

The ink supply port plate 425 is a 100 $\mu$m thick thin sheet of a stainless steel provided with through holes 419 for interconnecting the nozzle openings 429 of the nozzle plate 427 and the pressure chambers 411, and the ink supply ports 418 connecting reservoirs 450 and 452 (451 and 453) to the pressure chambers 411 and having a flow resistance of a level that permits jetting an ink drop. The ink supply port plate 425 is provided with four ink inlet ports 454 to 457 formed in a row parallel to a direction in which a carriage moves at positions spaced apart from the reservoirs 450 and 452 (451 and 453).

Figure 20:
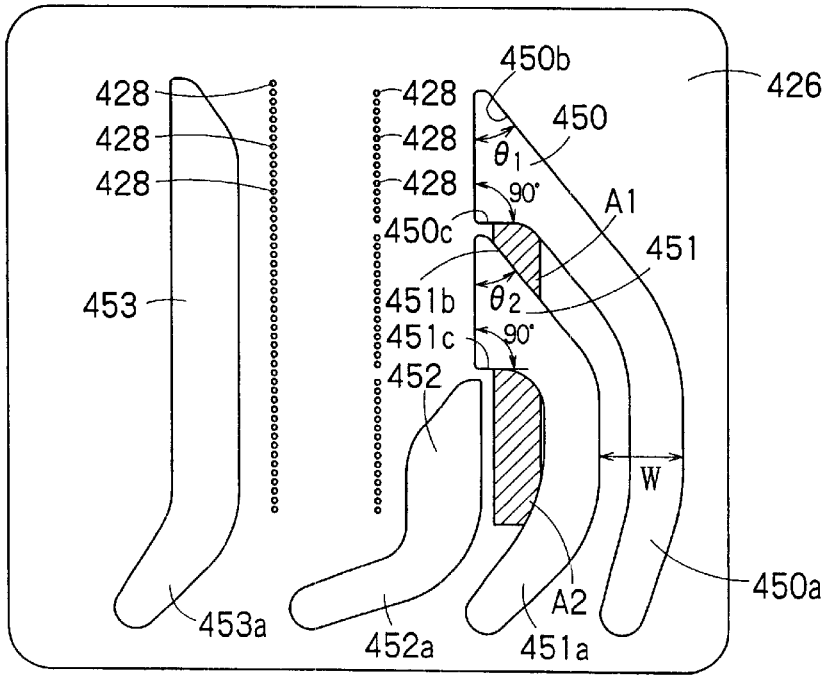
FIG. 20 is a plan view of a reservoir plate included in the ink-jet recording head shown in FIG. 15.

Referring to FIG. 20, the reservoir plate 426 is, for example, a 150 $\mu$m thick corrosion-resistant plate of a stainless steel or the like suitable for forming the reservoirs 450 and 452 (451 and 453) and provided with a reservoir 453 formed in its left portion to supply the ink to all the pressure chambers 411 on the left side, as viewed in the drawing, three reservoirs 450, 451 and 452 for individually supplying the inks to the pressure chambers 411 on the right side, as viewed in the drawing showing the actuator unit, and connecting holes 428 for connecting the pressure chambers 411 to the nozzle openings 429. The pressure chambers 411 arranged in a row parallel to the feed direction (top and bottom direction in the drawing) are divided equally into three groups. In this embodiment, each of the three groups has fifteen pressure chambers 411. The reservoirs 450, 451 and 452 are formed in a size that enables each of the reservoirs 450, 451 and 452 to cover the ink supply ports 418 connected to the fifteen pressure chambers 411. The reservoir 452 among the reservoirs 450, 451 and 542 is formed in a region overlapping a region in which the pressure chambers 411 are formed so that the ink supply ports 418 form an axis of symmetry.

The reservoirs 450 to 453 are connected to the ink inlet ports 454, 455, 456 and 457 formed in the ink supply port plate 425 by ink passages 450*a* to 453*a*, respectively. The ink passages 450*a* and 451*a* connected respectively to the reservoirs 450 and 451 are formed in parallel to each other outside a region in which the pressure chambers 411 are formed. The ink passage 452*a* connected to the reservoir 452 is formed in a region overlapping the region in which the pressure chambers 411 are formed; that is, the ink passage 452*a* is formed from the inside to the ink inlet port 456.

The position of the outermost ink passage 450*a* can be shifted inside by a distance W approximately equal to the width of the ink passage as shown in FIG. 20 by using a region inside the region in which the pressure chambers 411 are formed as a reservoir forming region, so that the recording head can be formed in a small width.

Black, yellow, magenta and cyan inks can be supplied to the reservoirs 453, 450, 451 and 452, respectively. The ink passages 450*a* and 451*a* extending from the ink inlet ports 454 and 455 to the ink supply ports 418 are formed in a substantially uniform width substantially over the entire length thereof.

Thus, the ink flows from the ink inlet ports 454 and 455 to the ink supply ports 418 at substantially constant velocity, the stagnation of the ink due to irregular flow velocity can be prevented and bubbles can be satisfactorily removed from the ink passages and the reservoirs.

As shown in FIG. 20, portions of upstream walls 450*c* and 451*c* nearest to the ink inlet ports 454 and 455, i.e., the lower side walls as viewed in FIG. 20, are formed so as to extend perpendicularly to the row of the ink supply ports 418, and area of a partition wall between the adjacent reservoirs is increased partially to secure the largest possible regions A1 and A2.

Therefore, it is possible to bond together the actuator unit 401 and the ink supply port plate 425 with the adhesive film 424 with a spacer underlying the terminal unit 416 of the actuator unit 401. Consequently, it is possible to prevent the projection of the adhesive film 424 into the ink supply ports 418 due to the excessive compression of the adhesive film 424.

Portions of downstream walls 450*b* and 451*b* farthest from the ink inlet ports 454 and 455 are formed so as to extend at angles $\theta_1$ and $\theta_2$ in the range of 30° to 45° to the row of the ink supply ports 418.

Bubbles are liable to be collected in the corners if the angles $\theta_1$ and $\theta_2$ are smaller than 30°, and the inks stagnate if the angles $\theta_1$ and $\theta_2$ are greater than 45°.

Since the ink passages 450*a* and 451*a* connected to the reservoirs 450 and 451 are curved in the shape of arcs of circles, respectively, the inks flow smoothly without stagnating therein and bubbles are prevented from staying in the ink passages and the reservoirs.

Since the ink passages 450*a* and 451*a* are formed concentrically and the ink passages 450*a* and 451*a* are separated from each other by a partition wall of a substantially fixed width, the partition wall can be formed uniformly in the least necessary width taking into consideration the rigidity of the reservoir plate 426 and the squeeze of the adhesive film and hence any dead space is not formed in the partition wall.

The nozzle plate 427 is provided with the nozzle openings 429 connected through the connecting holes 428, the through holes 419 and the connecting holes 420 to the actuator unit 401. In FIGS. 16 and 17, indicated at reference numerals 458 to 461 are thin-wall parts serving as compliance regions formed in the ink supply port plate 425 so as to correspond to the reservoirs 450 to 453, respectively. Generally, portions of the reservoirs around the ink supply ports have a small area. Therefore, it is difficult to secure a sufficient compliance only by the reservoirs 450 and 451. Since the thin-wall parts 458 to 461 that can be elastically deformed by ink pressure are formed in regions including portions of the ink passages 450*a* and 451*a* on the side of the reservoirs 450 and 451 in addition to the regions corresponding to the reservoirs 450 and 451, a compliance on a level that will not cause difficulty in jetting ink drops can be secured.

The recording head is mounted on a carriage with the rows of the nozzle openings 429 extended in the feed direction in which the recording sheet is fed, a black ink is supplied to the reservoir 453 of the passage unit 402, and yellow, cyan and magenta inks are supplied respectively to the reservoirs 450, 451 and 452. Black dot forming signals are given to the piezoelectric vibrators 413, i.e., pressure generators (pressure producing devices), arranged on the left side, as viewed in the drawing, and color dot forming signals are given to the piezoelectric vibrators 413 arranged on the right side, as viewed in the drawing.

Yellow dot forming signals are given to the piezoelectric vibrators 413 corresponding to the pressure chambers 411 connected to the reservoir 450, magenta dot forming signals are given to the piezoelectric vibrators 413 corresponding to the pressure chambers 411 connected to the reservoir 451, and cyan dot forming signals are given to the piezoelectric vibrators 413 corresponding to the pressure chambers 411 connected to the reservoir 452.

When black dot forming signals are given to the piezoelectric vibrators 413 on the left side, as viewed in the drawing, the same piezoelectric vibrators 413 warp so as to apply pressure to the black ink contained in the pressure chambers 411 on the left side, as viewed in the drawing. Consequently, the black ink flows through connecting holes 428, the through holes 419 and the connecting holes 420 and black ink drops are jetted through the nozzle openings 429.

When the dot forming signals are cut off, the piezoelectric vibrators 413 return to their original state to permit the pressure chambers 411 to expand. Consequently, the ink flows from the reservoir 453 through the ink supply ports 418 into the pressure chambers 411.

When color dot forming signals are given to the piezoelectric vibrators 413 on the right side, as viewed in the drawing, the same piezoelectric vibrators 413 warp so as to apply pressure to the inks contained in the pressure chambers 411 on the right side, as viewed in the drawing. Consequently,the color inks flow through the connecting holes 428, the through holes 419 and the connecting holes 420 of the passage unit 402 and are jetted in ink drops through the nozzle openings 429.

When the dot forming signals are cut off, the piezoelectric vibrators 413 returns to their original state to permit the pressure chambers 411 to expand. Consequently, the color inks flow from the reservoirs 450, 451 and 452 through the ink supply ports 418 into the pressure chambers 411.

Since the nozzle openings 429 for the color inks are divided into the color groups each the fifteen successive nozzle openings 429, color dots can be formed at the same position by adjusting the feed of the recording sheet to a recording width for each color. The foregoing process is repeated for printing.

When printing text data or monochromatic picture data, only the piezoelectric vibrators 513 corresponding to the pressure chambers 411 arranged in a row parallel to the sheet feed direction on the right side, as viewed in the drawing, are driven. Monochromatic characters and pictures can be printed in a width in the sheet feed direction about three times greater than that for color printing.

The recording head in the fourth embodiment is provided with the single actuator unit. The recording head may be provided with an actuator unit provided with a very large number of pressure chambers or may be provided with a plurality of actuator units arranged in the sheet feed direction, provided that pressure chambers arranged on one side of the actuator unit can be used for printing black dots, pressure chambers arranged on the other side of the actuator unit can be divided into a plurality of groups and the inks can be individually supplied to those groups.

Fifth Embodiment

Figure 22:
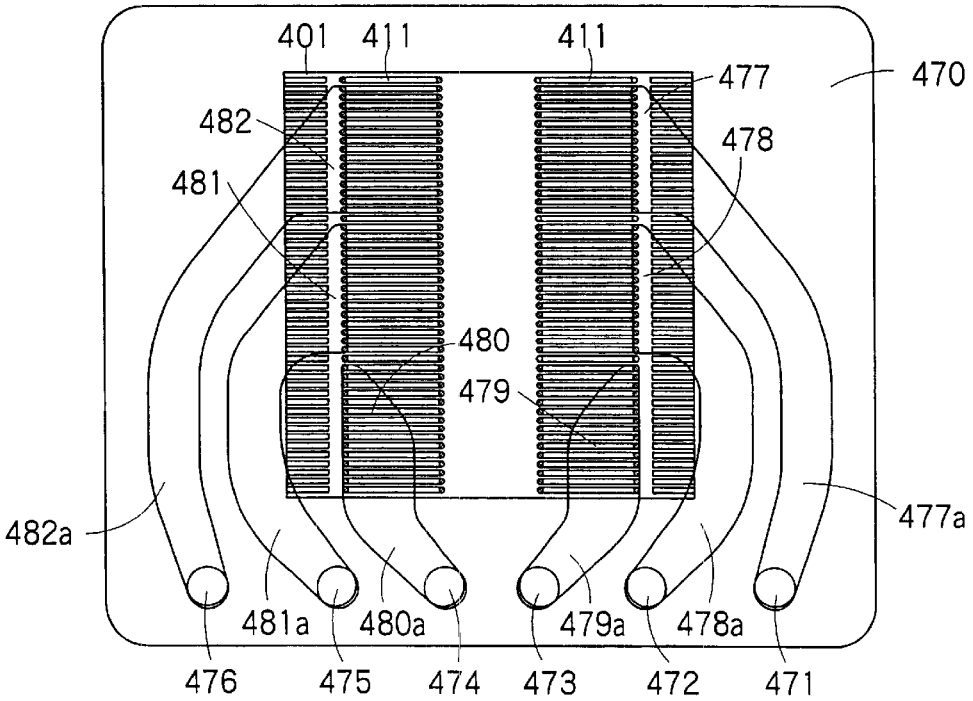
FIG. 22 is a plan view showing the relation between an actuator unit and reservoirs in a fifth embodiment according to the present invention.

FIG. 22 shows an ink-jet recording head in a fifth embodiment according to the present invention. The ink-jet recording head in the fifth embodiment is a modification of the ink-jet recording head in the fourth embodiment. The ink-jet recording head in the fifth embodiment is capable of jetting six kinds of inks at the maximum.

Ink inlet ports 471, 472, 473, 474, 475 and 476 are formed in a line parallel to a scanning direction on the lower side of an actuator unit 401. Upstream ends of ink passages 477*a*, 478*a*, 479*a*, 480*a*, 481*a* and 482*a* are connected to the ink inlet ports 471 to 476, respectively.

The actuator unit 401 is provided with a plurality of pressure chambers 411 arranged in two rows. The pressure chambers 411 in each row are divided into three groups; that is the pressure chambers 411 are divided into six groups. Reservoirs 477, 478, 479, 480, 481 and 482 are connected to the six groups, respectively. The reservoirs 477, 478, 181 and 482 are connected to the pressure chambers from the outside of the actuator unit, and the reservoirs 479 and 480 are connected to the pressure chambers from the inside of the actuator unit.

Inks of different colors, i.e., black, yellow, deep magenta, light magenta, deep cyan and light cyan inks, are supplied through the ink inlet ports 471 to 476, respectively. Thus, a recording apparatus capable of color printing using six color inks can be constructed in a small size along a scanning direction.

Although the invention has been described as applied to the recording head including the pressure chambers and the piezoelectric vibrators that vibrate to expand and contract the corresponding pressure chambers, the present invention may be applied to a recording head provided with piezoelectric vibrators capable of vibrating in a longitudinal vibration mode and each having one end held in contact with an elastic plate and to a recording head provided with heating devices that heats pressure chambers to apply pressure to the ink contained in the pressure chambers.

INDUSTRIAL APPLICABILITY

The present invention is applicable to recording heads of ink-jet recording apparatuses to be used as ink-jet printers or ink-jet plotters.

What is claimed is:

1. An ink-jet recording head comprising:

an actuator unit provided with a plurality of pressure chambers arranged in a row, and a plurality of pressure generators for applying pressure to inks contained in the pressure chambers; and a passage unit provided with a plurality of nozzle openings communicating with the pressure chambers to jet ink drops when pressures are applied to the inks contained in the pressure chambers by the pressure generators, and two or more common ink chambers containing inks to be supplied to the pressure chambers;

wherein the pressure chambers arranged in a row are divided into a plurality of groups along the row, and the common ink chambers are assigned to the groups of the pressure chambers, respectively, and further wherein said pressure chambers are not provided in a plane that also includes at least one of said common ink chambers.

2. The ink-jet recording head according to claim 1, wherein the pressure chambers are formed in a single plate, the two or more common ink chambers are formed in another single plate, and the actuator unit and the passage unit are stacked together.

3. The ink-jet recording head according to claim 1, wherein, the groups of the pressure chambers correspond to colors of the inks to be jetted through the nozzle openings, respectively.

4. The ink-jet recording head according to claim 1, wherein the pressure chambers are arranged in a plurality of rows.

5. The ink-jet recording head according to claim 1, wherein at least one of said common ink chambers is formed in a region either directly above or directly below that of said pressure chambers so that the regions overlap one another.

6. An ink-jet recording head comprising:

an actuator unit provided with a plurality of pressure chambers arranged in a row, and a plurality of pressure generators for applying pressure to inks contained in the pressure chambers; and a passage unit provided with a plurality of nozzle openings communicating with the pressure chambers to jet ink drops when pressures are applied to the inks contained in the pressure chambers by the pressure generators, and two or more common ink chambers containing inks to be supplied to the pressure chambers;

wherein the pressure chambers arranged in a row are divided into a plurality of groups along the row, and the common ink chambers are assigned to the groups of the pressure chambers, respectively, and further wherein each of the pressure chambers has a first end part and a second end part, the nozzle openings are connected to the first or the second end parts, the common ink chambers are connected to the second or the first end parts, the same end parts of the pressure chambers included in the same group are connected to the nozzle openings, and the end parts connected to the nozzle openings are different between one of the groups and another one of the groups adjacent to the one of the groups.

7. The ink-jet recording head according to claim 6, wherein a first plate, a second plate, a third plate and a fourth plate are stacked successively, the first plate is provided with a plurality of pressure chamber forming holes forming the pressure chambers, respectively, the second plate is provided with a plurality of pairs of connecting holes connected to the first and the second end parts of the pressure chambers, respectively, the third plate is provided with a plurality of ink supply ports each connected to one of the connecting holes of each pair and two or more common ink chamber forming holes connected to the other one of the connecting holes of each pair and forming the two or more common ink chambers, and the fourth plate is provided with the nozzle openings.

8. The ink-jet recording head according to claim 7 further comprising a fifth plate sandwiched between the second and the third plate, wherein the fifth plate has a thin-wall part serving as a compliance part formed in a region overlapping the common ink chamber forming hole formed in the third plate to absorb a variation of a pressure applied to the ink contained in the common ink chamber.

9. The ink-jet recording head according to claim 6, wherein at least one of the two or more common ink chambers is formed in a region overlapping a region in which the pressure chambers are formed and the other common ink chamber is formed in a region outside the region in which the pressure chambers are formed.

10. The ink-jet recording head according to claim 6, wherein the pressure generators include a plurality of piezoelectric vibrators and a plurality of terminals connected to the piezoelectric vibrators to apply voltages to the piezoelectric vibrators, and the two or more common ink chambers are formed in a region outside a region in which the terminals are formed.

11. The ink-jet recording head according to claim 6, further comprising, in addition to the pressure chambers arranged in a row, a plurality of pressure chambers formed in another row parallel to the row of the pressure chambers, and a common ink chamber containing an ink to be supplied to all the pressure chambers arranged in the another row.

12. The ink-jet recording head according to claim 6, wherein the adjacent groups of the pressure chambers are separated from each other by a partition wall of a width substantially corresponding to a width of the pressure chamber.

13. An ink-jet recording head comprising:

an actuator unit provided with a plurality of pressure chambers arranged in a row, and a plurality of pressure generators for applying pressure to inks contained in the pressure chambers; and a passage unit provided with a plurality of nozzle openings communicating with the pressure chambers to jet ink drops when pressures are applied to the inks contained in the pressure chambers by the pressure generators, and two or more common ink chambers containing inks to be supplied to the pressure chambers;

wherein the pressure chambers arranged in a row are divided into a plurality of groups along the row, and the common ink chambers are assigned to the groups of the pressure chambers, respectively, and wherein the passage unit is provided further with two or more ink passages for supplying inks to the two or more common ink chambers, each of the pressure chambers has a first end part and a second end part, the nozzle openings are connected to the first end parts, the common ink chambers are connected to the second end parts, and at least one of the two or more common ink chambers is formed on a side opposite to a side on which another one of the two or more common ink chamber is formed with respect to a line along which the second end parts of the pressure chambers are arranged.

14. The ink-jet recording head according to claim 13, wherein the common ink chamber formed in a region outside a region in which the pressure chambers are formed has a width decreasing in a direction away from the second end parts of the pressure chambers.

15. The ink-jet recording head according to claim 14, wherein the common ink chamber formed in the region outside the region in which the pressure chambers are formed has a downstream wall forming the common ink chamber at a position remote from an upstream end of the ink passage, the downstream wall is inclined at an angle in a range of 30° to 45° to the line along which the second end parts of the pressure chambers are arranged.

16. The ink-jet recording head according to claim 14, wherein the common ink chamber formed in the region outside the region in which the pressure chambers are formed has an upstream wall forming the common ink chamber at a position near an upstream end of the ink passage, the upstream wall extends substantially perpendicularly to the line along which the second end parts of the pressure chambers are arranged.

17. The ink-jet recording head according to claim 13, wherein the ink passages are formed in a plane including the common ink chambers.

18. The ink-jet recording head according to claim 17, wherein a number of the common ink chambers is at least three, at least two of the common ink chambers are formed in the region outside the region in which the pressure chambers are formed, and at least two of the ink passages connected to the at least two of the common ink chambers are formed in arcs of substantially concentric circles, respectively.

19. The ink-jet recording head according to claim 18, wherein a distance between the at least two of the ink passages connected to the at least two of the common ink chambers formed in the region outside the region in which the pressure chambers are formed is substantially constant over substantially entire lengths of the at least two of the ink passages.

20. The ink-jet recording head according to claim 13, wherein a part of the common ink chamber is formed by a thin-wall portion and a part of the ink passage is formed by a thin-wall portion near the common ink chamber.

21. The ink-jet recording head according to claim 13, wherein each of the at least two of the ink passages has a substantially uniform width over a substantially entire length thereof.

* * * * *